US012018846B2

(12) United States Patent
Erisgen et al.

(10) Patent No.: US 12,018,846 B2
(45) Date of Patent: Jun. 25, 2024

(54) PERSONAL PORTABLE HEATER

(71) Applicant: Pinnacle Climate Technologies, Inc., Eden Prairie, MN (US)

(72) Inventors: Sukru Erisgen, Eden Prairie, MN (US); Jacob Frame, Eden Prairie, MN (US)

(73) Assignee: Pinnacle Climate Technologies, Inc., Eden Prairie, MN (US)

( * ) Notice: Subject to any disclaimer, the term of this patent is extended or adjusted under 35 U.S.C. 154(b) by 484 days.

(21) Appl. No.: 17/387,624

(22) Filed: Jul. 28, 2021

(65) Prior Publication Data

US 2022/0034515 A1 Feb. 3, 2022

Related U.S. Application Data

(60) Provisional application No. 63/199,704, filed on Jan. 19, 2021, provisional application No. 63/074,663, filed on Sep. 4, 2020, provisional application No. 63/057,629, filed on Jul. 28, 2020.

(51) Int. Cl.

| | |
|---|---|
| ***F24C 3/14*** | (2021.01) |
| ***F23D 14/16*** | (2006.01) |
| ***F24C 3/08*** | (2006.01) |
| ***F24C 3/12*** | (2006.01) |
| ***F24C 15/34*** | (2006.01) |

(52) U.S. Cl.

CPC ..... *F24C 3/14* (2013.01); *F23D 14/16* (2013.01); *F24C 3/082* (2013.01); *F24C 3/122* (2013.01); *F24C 15/34* (2013.01)

(58) Field of Classification Search

CPC .. F24C 3/082; F24C 3/122; F24C 3/14; F24C 15/34; F23D 14/16

See application file for complete search history.

(56) References Cited

U.S. PATENT DOCUMENTS

| | | | |
|---|---|---|---|
| D145,913 | S | 11/1946 | Swartzbaugh |
| 2,565,390 | A | 8/1951 | Mitnowsky |
| 4,673,349 | A | 6/1987 | Abe et al. |

(Continued)

FOREIGN PATENT DOCUMENTS

| | | | |
|---|---|---|---|
| CA | 2 650 400 | C | 4/2011 |
| CA | 2 541 122 | C | 1/2012 |

(Continued)

OTHER PUBLICATIONS

Dyna-Glo User Manual and Operating Instructions, 20 pages (2015).

(Continued)

*Primary Examiner* — Alfred Basichas

(74) *Attorney, Agent, or Firm* — Merchant & Gould P.C.

(57) ABSTRACT

A portable heater can include a housing including a base and an enclosure and a burner assembly disposed within the enclosure, the burner assembly including a heating surface, wherein the enclosure and the heating surface are rotatable, with respect to the base, between a first rotational position and a second rotational position. In some examples, the heating surface is a curved surface. In some examples, a tilt switch is provided that has a position that is independent of the rotational position of the enclosure. The portable heater can also include temperature control features for maintaining fuel tank temperature at an improved operating condition.

12 Claims, 35 Drawing Sheets

(56) References Cited

U.S. PATENT DOCUMENTS

| | | | | |
|---|---|---|---|---|
| 5,167,216 | A * | 12/1992 | Yeung | F27B 17/00 99/403 |
| 5,807,098 | A | 9/1998 | Deng | |
| 6,340,298 | B1 | 1/2002 | Vandrak et al. | |
| 6,446,623 | B1 | 9/2002 | Resmo et al. | |
| 6,648,635 | B2 | 11/2003 | Vandrak et al. | |
| 6,742,814 | B2 | 6/2004 | Resmo et al. | |
| 6,843,244 | B2 | 1/2005 | McCalley et al. | |
| 6,884,065 | B2 | 4/2005 | Vandrak et al. | |
| 7,300,278 | B2 | 11/2007 | Vandrak et al. | |
| 8,053,709 | B2 | 11/2011 | Vandrak et al. | |
| 8,068,724 | B2 | 11/2011 | Vandrak et al. | |
| D660,946 | S | 5/2012 | Sengoku et al. | |
| 8,347,875 | B2 | 1/2013 | Jamieson | |
| 8,434,469 | B2 | 5/2013 | Vandrak | |
| 8,487,221 | B2 | 7/2013 | Vandrak et al. | |
| 8,490,639 | B2 | 7/2013 | Vandrak | |
| 8,494,350 | B2 | 7/2013 | O'Toole et al. | |
| 8,863,736 | B2 | 10/2014 | Vandrak | |
| 8,893,706 | B2 | 11/2014 | Vandrak et al. | |
| 8,893,707 | B2 | 11/2014 | Jamieson | |
| 9,267,708 | B2 | 2/2016 | Jamieson | |
| 9,927,144 | B2 | 3/2018 | Vandrak et al. | |
| 10,036,571 | B1 | 7/2018 | Gove et al. | |
| D864,365 | S | 10/2019 | Downing et al. | |
| 10,495,344 | B2 | 12/2019 | Vandrak et al. | |
| 10,544,871 | B2 | 1/2020 | Vandrak et al. | |
| D907,753 | S | 1/2021 | Tschopp | |
| 2006/0185660 | A1 * | 8/2006 | Sords | F24C 3/042 126/92 AC |
| 2008/0152329 | A1 | 6/2008 | Saunders et al. | |
| 2010/0139651 | A1 | 6/2010 | Vandrak | |
| 2010/0147291 | A1 | 6/2010 | Vandrak | |
| 2011/0045417 | A1 | 2/2011 | Vandrak | |
| 2011/0162632 | A1 * | 7/2011 | DiVentura | F23D 14/34 431/6 |
| 2012/0094244 | A1 | 4/2012 | Vandrak | |
| 2012/0196237 | A1 | 8/2012 | Murray et al. | |
| 2015/0276217 | A1 | 10/2015 | Karkow et al. | |
| 2017/0254544 | A1 | 9/2017 | Beerens et al. | |
| 2017/0363326 | A1 | 12/2017 | Vandrak et al. | |
| 2017/0363327 | A1 | 12/2017 | Vandrak et al. | |
| 2019/0041093 | A1 | 2/2019 | Vandrak et al. | |
| 2019/0170349 | A1 | 6/2019 | Martin | |
| 2020/0072500 | A1 | 3/2020 | Vandrak et al. | |
| 2020/0149645 | A1 | 5/2020 | Vandrak et al. | |
| 2021/0116129 | A1 | 4/2021 | Erisgen | |

FOREIGN PATENT DOCUMENTS

| | | | |
|---|---|---|---|
| CA | 2 759 762 | C | 6/2013 |
| CA | 2 759 775 | C | 9/2013 |
| CA | 2 759 864 | C | 10/2013 |
| CA | 2 759 969 | C | 12/2013 |
| CA | 2 713 971 | C | 12/2014 |
| CA | 2 759 926 | C | 12/2014 |
| CA | 3 040 273 | A1 | 4/2018 |
| CA | 2 988 129 | A1 | 12/2018 |
| CN | 100549551 | C | 10/2009 |
| CN | 101517319 | B | 12/2013 |
| CN | 106337956 | A | 1/2017 |
| CN | 205897325 | U | 1/2017 |
| CN | 108151127 | A | 6/2018 |
| CN | 208418931 | U | 1/2019 |
| CN | 209147210 | U | 7/2019 |
| KR | 20-1995-0010234 | Y1 | 11/1995 |
| KR | 10-2013-0039243 | A | 4/2013 |
| KR | 10-1436280 | B1 | 8/2014 |
| WO | 2013/188909 | A1 | 12/2013 |

OTHER PUBLICATIONS

Mr. Heater 2018 Master Catalog, https://assets.unilogcorp.com/187/ITEM/DOC/100001967_Catalog.pdf, 68 pages, Enerco Group Inc. (2018).

U.S. Appl. No. 62/916,565, filed Oct. 17, 2019.

U.S. Appl. No. 63/057,629, filed Jul. 28, 2020.

International Search Report and Written Opinion for Application No. PCT/US2021/043296 mailed Nov. 8, 2021.

Mr. Heater MH18B Propane Heater, Red; Date First Available: Apr. 2, 2019 [online] [site visited Oct. 3, 2022] https://www.amazon.com/Mr-Heater-Corporation-MH18B-Portable/dp/B07Q82MG8S/ref=psdc_510182_t1_B09HY3WCMM?th=1 (Year: 2019).

Mr. Heater MH12HB Hunting Buddy Portable Space Heater, Camouflage; Review Date: Nov. 16, 2018 [online] [site visited Oct. 3, 2022] https://www.amazon.com/Mr-Heater-MH12B-Hunting-Portable/dp/B00CDJHIYW/ref=psdc_510182_t3_B09HY3WCMM (Year: 2018).

* cited by examiner

PERSONAL PORTABLE HEATER

RELATED APPLICATIONS

This application claims priority to U.S. Provisional Patent Application Ser. No. 63/057,629, filed Jul. 28, 2020, entitled "MULTI-DIMENSIONAL CERAMIC BURNER SURFACE"; U.S. Provisional Patent Application Ser. No. 63/074,663, filed Sep. 4, 2020, entitled "PERSONAL PORTABLE HEATER"; and U.S. Provisional Patent Application Ser. No. 63/199,704, filed Jan. 19, 2021, entitled "PERSONAL PORTABLE HEATER", the entireties of each of which are incorporated herein by reference.

TECHNICAL FIELD

The present disclosure relates generally to portable heaters.

BACKGROUND

Personal heaters using propane as a fuel are known. These types of heaters are used in indoor and outdoor applications to heat small spaces, mainly for the comfort of one or two people. These types of heaters are commonly referred to as portable heaters, cabinet heaters, or tank top heaters. In one example, U.S. Pat. No. 6,340,298 discloses a personal heater that is portable in nature and utilizes a propane tank as a fuel source. Portable propane gas-fired heaters can come in different sizes and shapes. Some heaters are configured to accept a one pound propane tank while other types are configured to additionally or alternatively accept a 20 pound propane tank. Typically, these types of portable heaters have a flat, fixed angle radiant heating surface. Although the particular heating surface angle may change from one heater to another, they are typically mounted a fixed angle for any given heater. Accordingly, when such a unit sits on the floor, a person standing in front of it will get only their feet or lower part of their body to receive radiated heat.

SUMMARY

An example propane gas-fired personal portable heater is disclosed. In one aspect, the personal heater has a tiltable housing having a multi-dimensional (curved) ceramic plaque. These combined features enable the disclosed portable heater to provide a greater effective heating area, as compared to the prior art. In one aspect, the design uses one or two one-pound propane gas tanks as a fuel source that are strategically placed inside the heater housing. With an adaptor, a larger propane tank may be connected.

A portable heater can include a housing including a base and an enclosure; and a burner assembly disposed within the enclosure, the burner assembly including a heating surface; wherein the enclosure and the heating surface are rotatable, with respect to the base, between a first rotational position and a second rotational position.

In some examples, a handle secured to the enclosure.

In some examples, the handle is rotatably mounted with respect to the frame.

In some examples, the second rotational position is about 60 degrees from the first rotational position.

In some examples, the first rotational position is between about 0 and 20 degrees with respect to a first plane, the first plane being orthogonal to a second plane defining a bottom-most portion of the base.

In some examples, the second rotational position is between about 30 and 60 degrees with respect to the first plane.

In some examples, the first rotational position is about 10 degrees with respect to a first plane, the first plane being orthogonal to a second plane defining a bottom-most portion of the base, and wherein the second rotational position is about 60 degrees with respect to the first plane.

In some examples, the heating surface is infinitely positionable between the first and second rotational positions.

In some examples, the heating surface is incrementally positionable between the first and second rotational positions.

In some examples, a positioning arrangement having a first indexing part associated with the base and a second indexing part associated with the enclosure is provided, wherein the first indexing part indexes with the second indexing part to provide incremental rotational positions between the enclosure and the base.

In some examples, a first side part mounted to a first side of the enclosure and a second side part mounted to a second side of the enclosure, wherein the second indexing part is mounted to the first side part.

In some examples, the first indexing part includes a pair of first indexing parts, wherein one of the first indexing parts is mounted to the first side part and the other of the first indexing parts is mounted to the second side part, and wherein the second indexing part includes a pair of second indexing parts mounted to the base.

In some examples, the first indexing part of the positioning arrangement is a spring clip.

In some examples, the second indexing part of the positioning arrangement is an arc-shaped member having a plurality of recesses for receiving the spring clip.

In some examples, the burner assembly includes a pilot light and an oxygen depletion sensor, wherein the pilot light and oxygen depletion sensor are operable between the first and second rotational positions.

In some examples, the burner assembly includes a gas pressure regulating valve configured to receive a fuel tank, wherein the gas pressure regulating valve is rotatable with respect to the enclosure.

In some examples, a mounting bracket operably coupled to the enclosure is provided, wherein the gas pressure regulating valve is rotatably mounted to the mounting bracket.

In some examples, the enclosure includes a first sidewall and a second sidewall, and the mounting bracket is located between the first and second sidewalls.

In some examples, a first retaining clip or magnet is provided for receiving a sidewall portion of the fuel tank, the first retaining clip or magnet being configured to prevent the fuel tank and pressure regulating valve from rotating with respect to the enclosure when the heating surface is rotated between the first and second positions.

In some examples, the enclosure includes a first sidewall and a second sidewall and further includes a first retaining clip or magnet located between the first and second sidewalls, the first retaining clip or magnet being configured to receive an individual propane tank and to prevent the fuel tank from rotating with respect to the enclosure when the heating surface is rotated between the first and second positions.

In some examples, a second retaining clip or magnet is located between the first and second sidewalls, the second retaining clip being or magnet configured to receive a second individual propane tank and to prevent the second fuel tank from rotating with respect to the enclosure when the heating surface is rotated between the first and second positions.

In some examples, the first and second retaining clips or magnets are each configured to receive a standard one pound propane tank.

In some examples, the burner assembly includes a heat shield separating the heating surface from a receiving area for receiving a fuel tank, wherein the heat shield includes one or more apertures for allowing heat from the heating surface to pass through to the receiving area.

In some examples, the heating surface is a curved surface.

In some examples, the heating surface is curved in a direction between first and second sides of the enclosure.

In some examples, the heating surface is straight in a direction between a top side and a bottom side of the enclosure.

A portable heater can include a housing including an enclosure and a base, the enclosure defining an interior space between a first sidewall and a second sidewall, the enclosure including a first mounting bracket located within the interior space; and a burner assembly disposed within the enclosure interior space, the burner assembly including a heating element, the heating element defining: a main body defining a curved outer heating surface; and a plurality of pores extending through the main body from a rear side to a front side.

In some examples, at least some of the plurality of pores are disposed in a non-parallel relationship with at least some others of the plurality of pores.

In some examples, the outer surface is curved only in a first direction.

In some examples, the heating surface is curved in a direction between first and second sides of the enclosure.

In some examples, the heating surface is straight in a direction between a top side and a bottom side of the enclosure.

In some examples, each of the plurality of pores is disposed generally orthogonally to the outer surface.

In some examples, the enclosure and the heating surface are rotatable, with respect to the base, between a first rotational position and a second rotational position.

In some examples, a handle is secured to the enclosure.

In some examples, the handle is rotatably mounted with respect to the frame.

In some examples, the second rotational position is about 60 degrees from the first rotational position.

In some examples, the first rotational position is between about 0 and 20 degrees with respect to a first plane, the first plane being orthogonal to a second plane defining a bottom-most portion of the base.

In some examples, the second rotational position is between about 30 and 60 degrees with respect to the first plane.

In some examples, the first rotational position is about 10 degrees with respect to a first plane, the first plane being orthogonal to a second plane defining a bottom-most portion of the base, and wherein the second rotational position is about 60 degrees with respect to the first plane.

In some examples, the heating surface is infinitely positionable between the first and second rotational positions.

In some examples, the heating surface is incrementally positionable between the first and second rotational positions.

In some examples, a positioning arrangement is provided having a first indexing part associated with the base and a second indexing part associated with the enclosure, wherein the first indexing part indexes with the second indexing part to provide incremental rotational positions between the enclosure and the base.

In some examples, a first side part mounted to a first side of the enclosure and a second side part mounted to a second side of the enclosure is provided, wherein the second indexing part is mounted to the first side part.

In some examples, the first indexing part includes a pair of first indexing parts, wherein one of the first indexing parts is mounted to the first side part and the other of the first indexing parts is mounted to the second side part, and wherein the second indexing part includes a pair of second indexing parts mounted to the base.

In some examples, the first indexing part of the positioning arrangement is a spring clip.

In some examples, the second indexing part of the positioning arrangement is an arc-shaped member having a plurality of recesses for receiving the spring clip.

In some examples, the burner assembly includes a pilot light and an oxygen depletion sensor, wherein the pilot light and oxygen depletion sensor are operable between the first and second rotational positions.

In some examples, the burner assembly includes a gas pressure regulating valve configured to receive a fuel tank, wherein the gas pressure regulating valve is rotatable with respect to the enclosure.

In some examples, a mounting bracket is operably coupled to the enclosure, wherein the gas pressure regulating valve is rotatably mounted to the mounting bracket.

In some examples, the enclosure includes a first sidewall and a second sidewall, and the mounting bracket is located between the first and second sidewalls.

In some examples, a first retaining clip or magnet is provided for receiving a sidewall portion of the fuel tank, the first retaining clip or magnet being configured to prevent the fuel tank and pressure regulating valve from rotating with respect to the enclosure when the heating surface is rotated between the first and second positions.

In some examples, the enclosure includes a first sidewall and a second sidewall and further includes a first retaining clip located or magnet between the first and second sidewalls, the first retaining clip or magnet being configured to receive an individual propane tank and to prevent the fuel tank from rotating with respect to the enclosure when the heating surface is rotated between the first and second positions.

In some examples, a second retaining clip or magnet is provided and located between the first and second sidewalls, the second retaining clip or magnet being configured to receive a second individual propane tank and to prevent the second fuel tank from rotating with respect to the enclosure when the heating surface is rotated between the first and second positions.

In some examples, the first and second retaining clips or magnets are each configured to receive a standard one pound propane tank.

In some examples, the burner assembly includes a heat shield separating the heating surface from a receiving area for receiving a fuel tank, wherein the heat shield includes one or more apertures for allowing heat from the heating surface to pass through to the receiving area.

A portable heater can include a housing including a base and an enclosure; and a burner assembly disposed within the enclosure, the burner assembly including a heating surface; a tilt switch operable to disable the burner assembly under a tilt condition; wherein the enclosure and the heating surface are rotatable, with respect to the base, between a first rotational position and a second rotational position; wherein the orientation of the tilt switch is independent of the enclosure and heating surface rotational position.

In some examples, the tilt switch is mounted to the base.

In some examples, the tilt switch is located within an interior volume of the enclosure.

In some examples, the burner assembly includes multiple heating elements.

A portable heater can include a housing including a base and an enclosure; and a burner assembly disposed within the enclosure, the burner assembly including a gas valve, a connection assembly for connecting a fuel tank to the gas valve, and a heating element connected to the gas valve and being secured to a burner housing; a rear heat shield located between the burner housing and the gas valve, the rear heat shield dividing the enclosure into a front portion including the heating element and a rear portion including the connection assembly, the rear heat shield including one or more apertures for allowing heat from the burner housing to provide heat to the enclosure rear portion.

In some examples, the enclosure and the heating surface are rotatable, with respect to the base, between a first rotational position and a second rotational position.

In some examples, the portable heater includes a rear cover at least partially enclosing the rear portion of the enclosure.

In some examples, the rear cover covers a top area of the rear portion and leaves a bottom area of the rear portion uncovered.

In some examples, the burner assembly includes multiple heating elements.

A variety of additional aspects will be set forth in the description that follows. The aspects relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
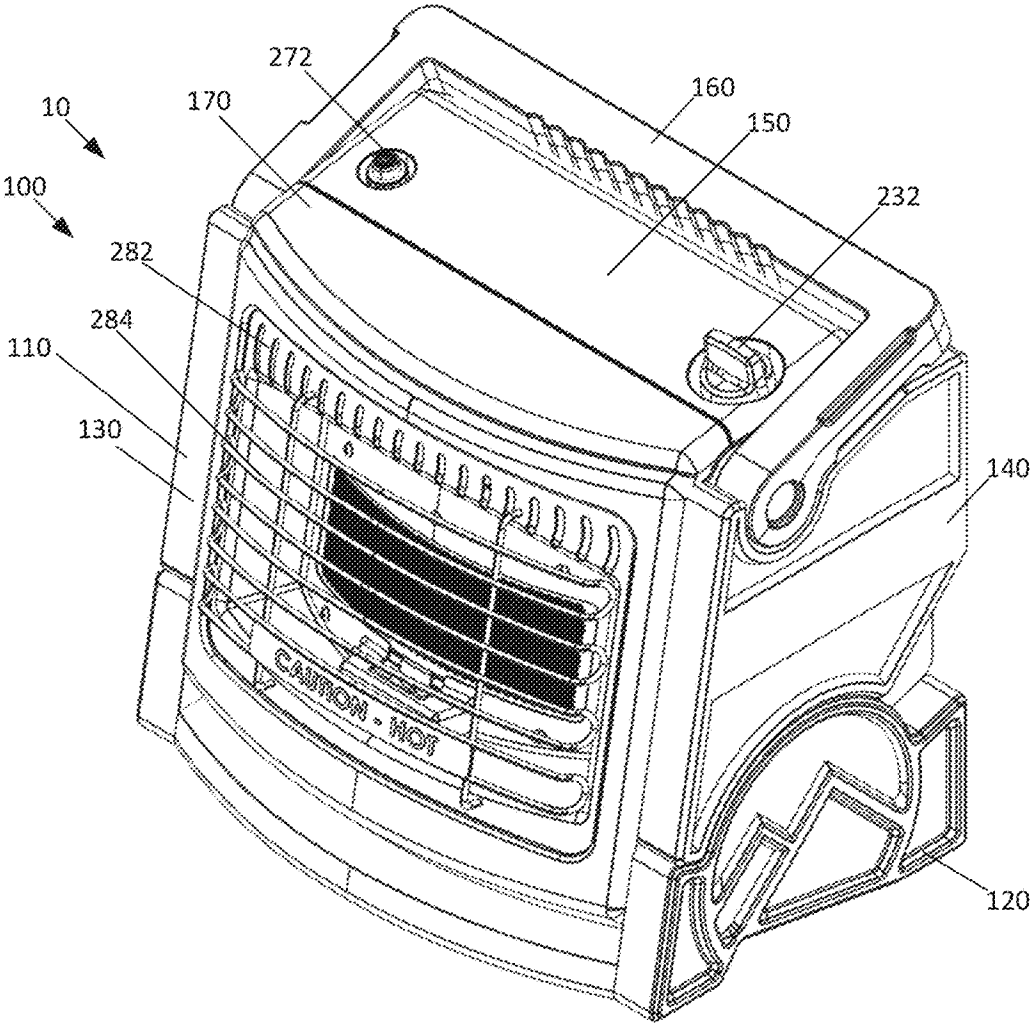
FIG. 1 is a front perspective of portable heater having features in accordance with principles of the disclosure.
Figure 2:
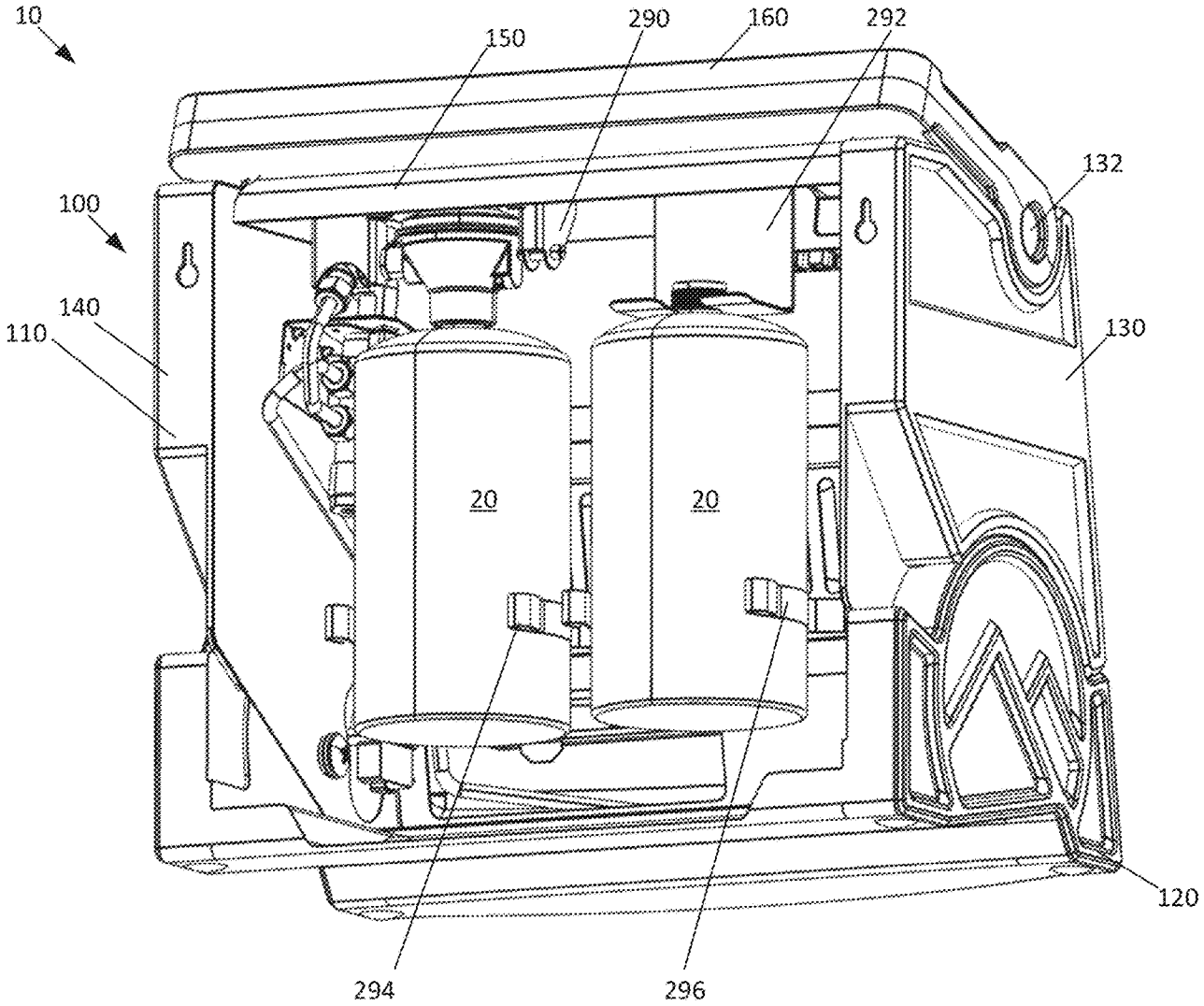
FIG. 2 is a rear perspective view of the portable heater shown in FIG. 1.
Figure 4:
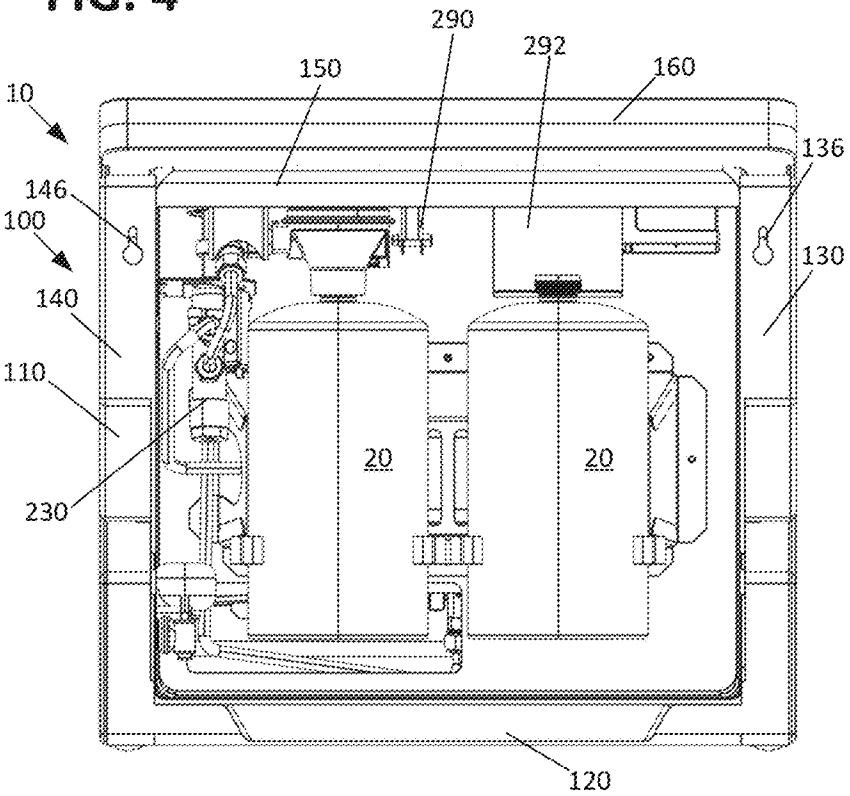
FIG. 4 is a rear view of the portable heater shown in FIG. 1.
Figure 3:
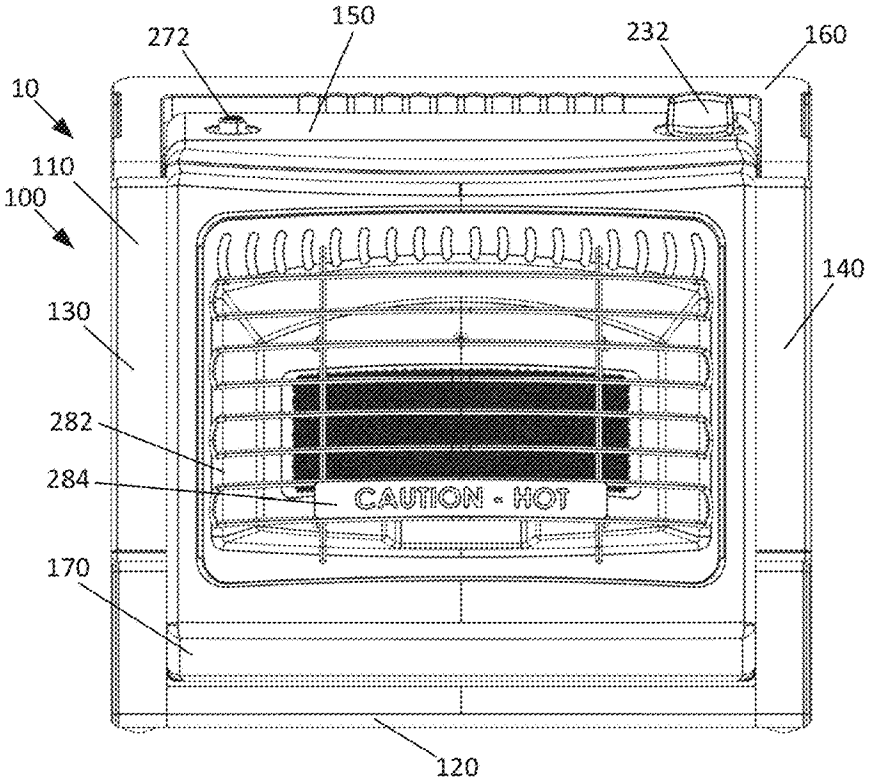
FIG. 3 is a front view of the portable heater shown in FIG. 1.
Figure 6:
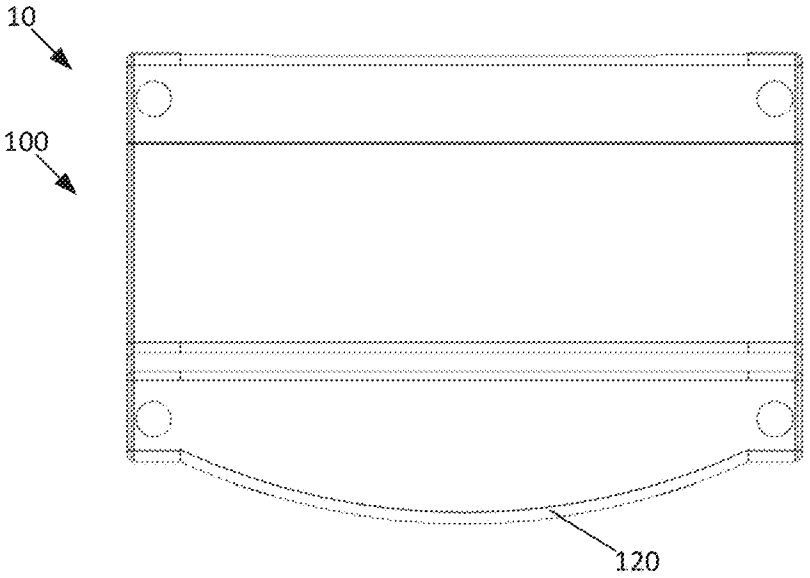
FIG. 6 is a bottom view of the portable heater shown in FIG. 1.
Figure 5:
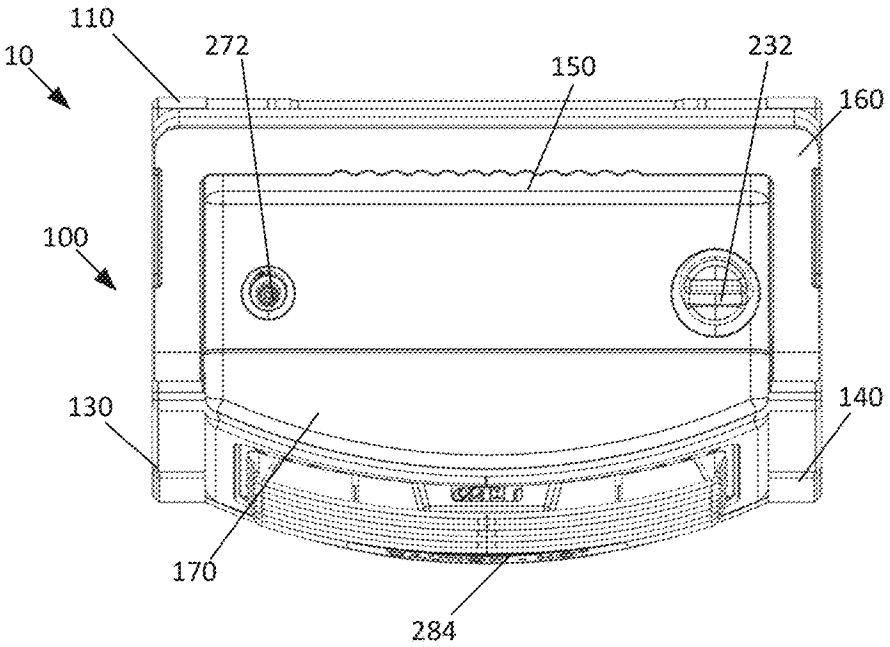
FIG. 5 is a top view of the portable heater shown in FIG. 1.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Housing Assembly 100

Figure 8:
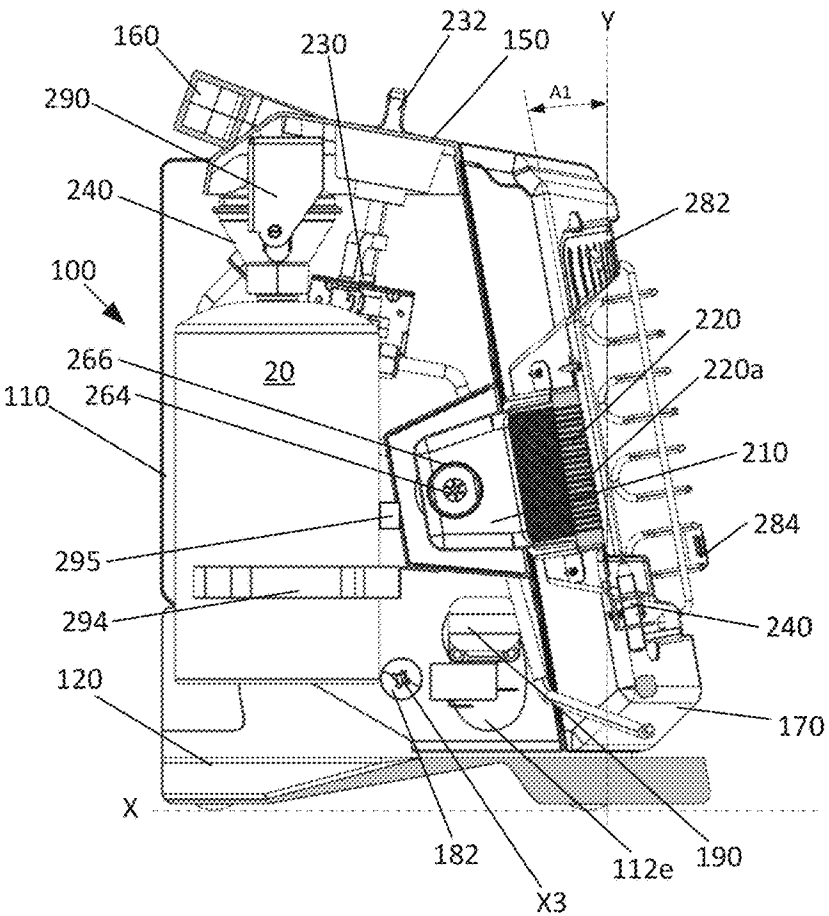
FIG. 8 is a cross-sectional side view of the portable heater shown in FIG. 7.
Figure 10:
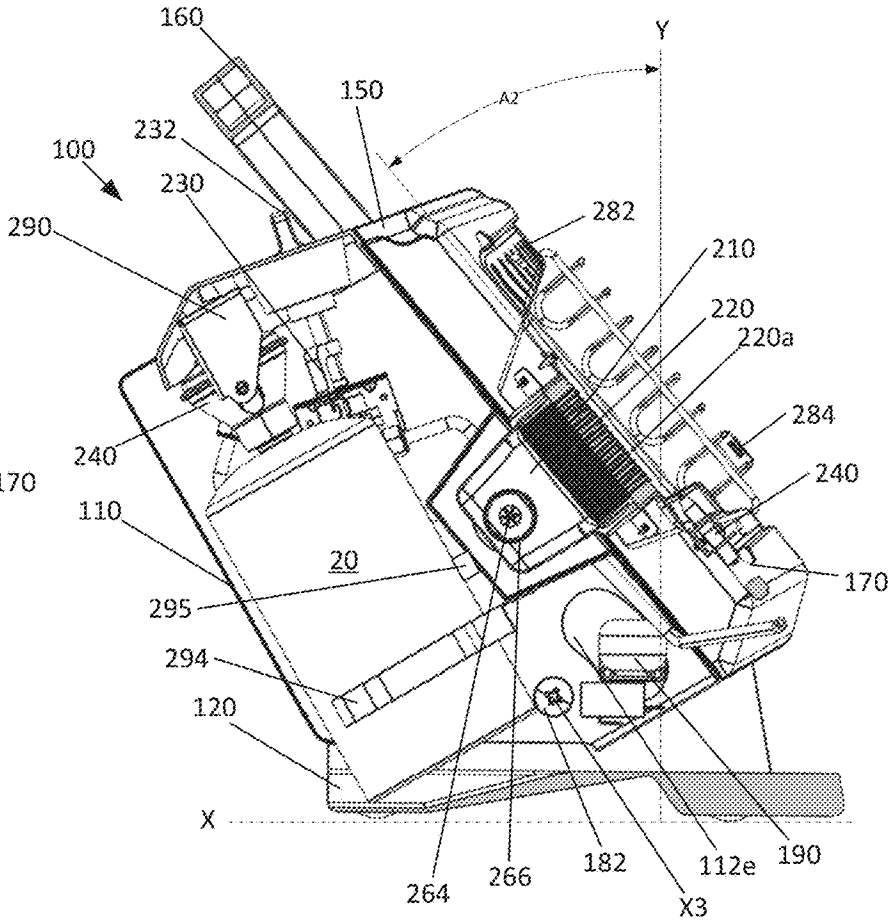
FIG. 10 is a cross-sectional side view of the portable heater shown in FIG. 9.
Figure 17:
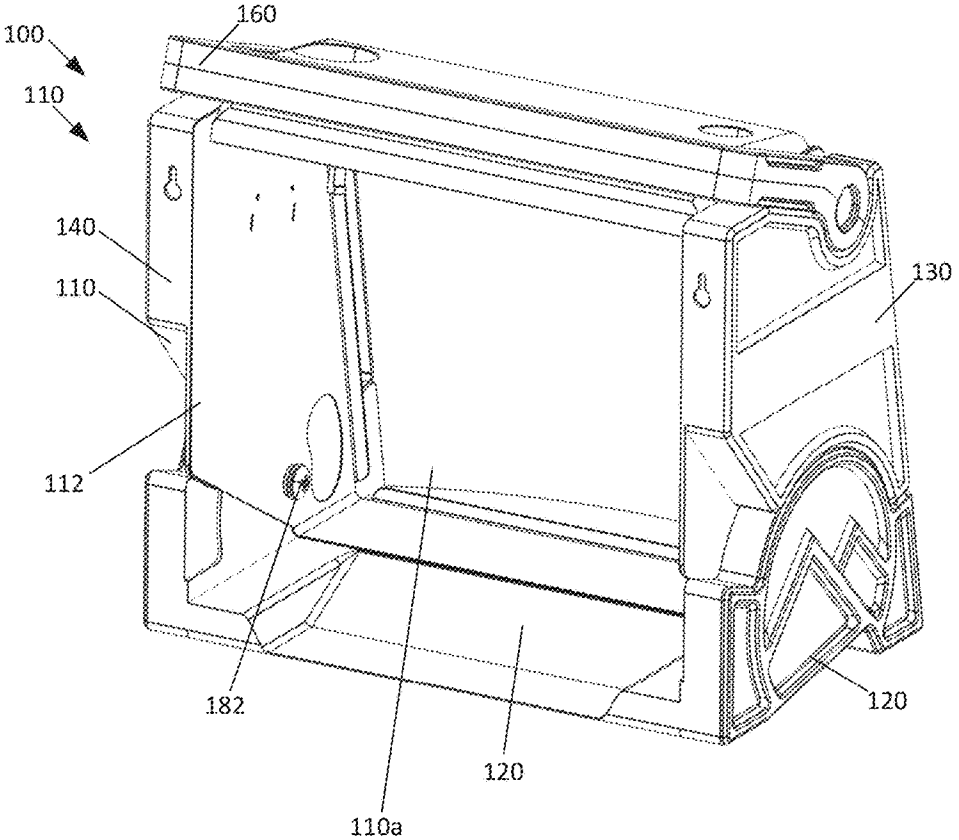
FIG. 17 is a rear perspective view of the housing of the portable heater shown in FIG. 1.

Referring to the Figures, a portable heater 10 is presented. In one aspect, the portable heater 10 is provided with a housing 100 within which a burner assembly 200 is disposed. With reference to FIGS. 1 to 11 and 17 to 25, features of the housing 100 are presented. In one aspect, the housing 100 includes an enclosure 110 rotatably mounted to a base 120. As most easily viewed at FIGS. 11 and 17, the enclosure 110 can be characterized as including a main frame 112 to which a first side part 130, a second side part 140, a top part 150, and a front part 170 are mounted. Collectively, these components can be characterized as defining an interior area or volume 110*a* of the enclosure 110, within which the burner assembly 200 is installed. These components of the housing 100 and/or enclosure 110 can be attached to each other and/or components of the burner assembly 200 by any conventional means, such as mechanical fasteners, including screws, bolts, and snap-type fittings. In the example depicted, and as is illustrated at FIGS. 8 and 10, the enclosure 110 and the burner assembly 200 are mounted in a fixed position relative to each other. As such, when the enclosure 110 is rotated relative to the base 120, as described below, the enclosure 110 and the burner assembly 200 rotate together.

Figure 27:
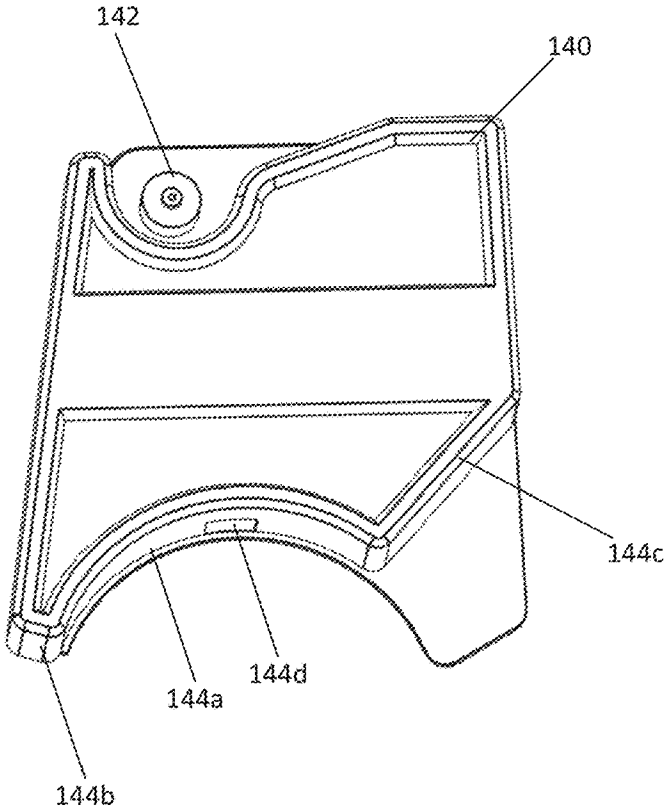
FIG. 27 is a perspective view of a second side housing part of the portable heater shown in FIG. 1.
Figure 26:
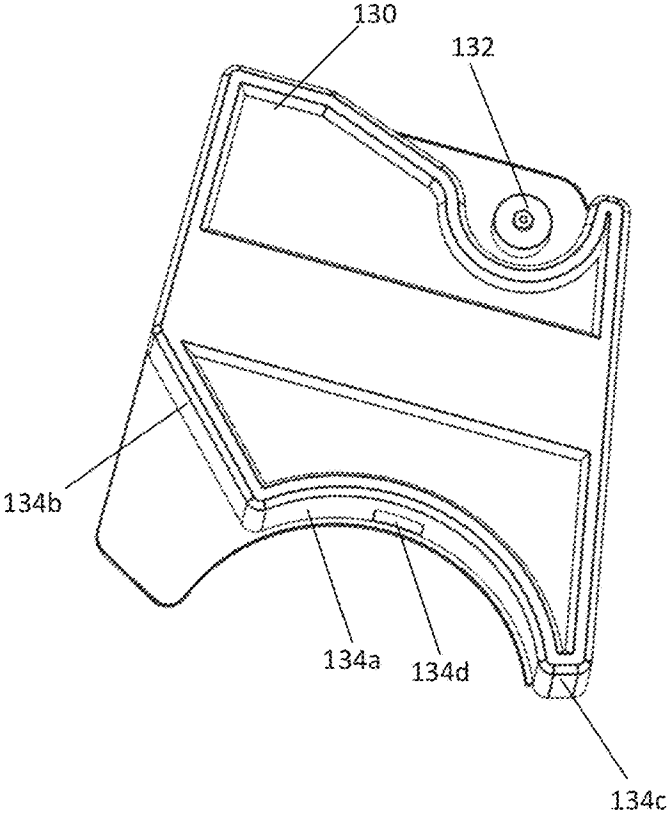
FIG. 26 is a perspective view of a first side housing part of the portable heater shown in FIG. 1.
Figure 29:
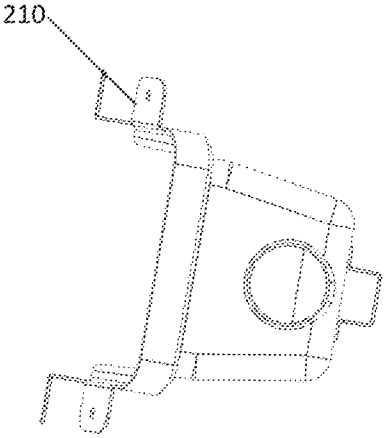
FIG. 29 is a side view of the burner housing shown in FIG. 28.
Figure 28:
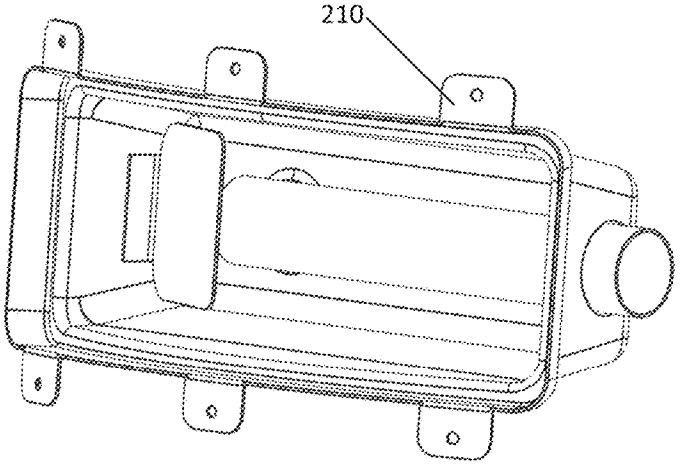
FIG. 28 is a front perspective view of a burner housing of the portable heater shown in FIG. 1.
Figure 31:
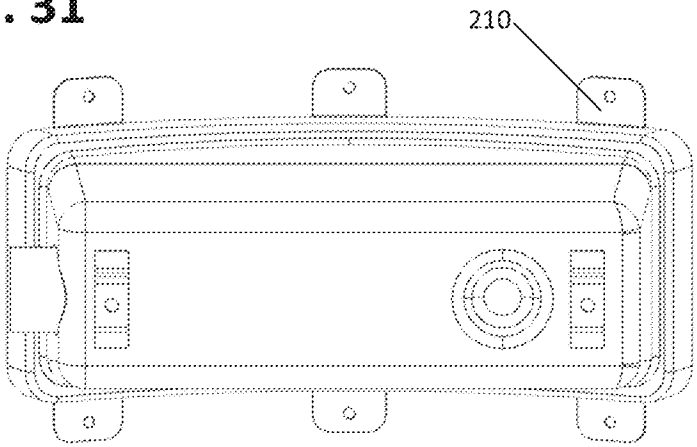
FIG. 31 is a rear view of the burner housing shown in FIG. 28.
Figure 30:
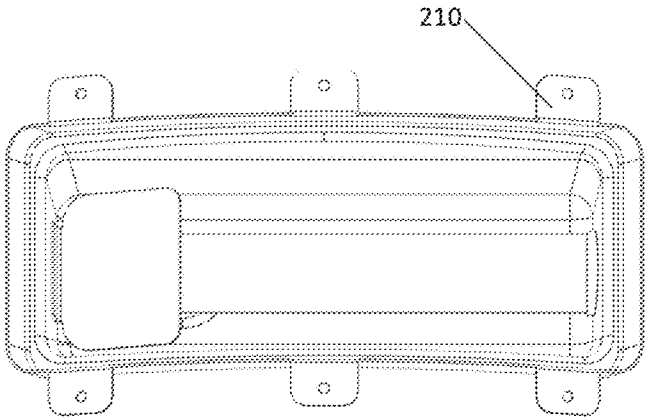
FIG. 30 is a front view of the burner housing shown in FIG. 28.
Figure 32:
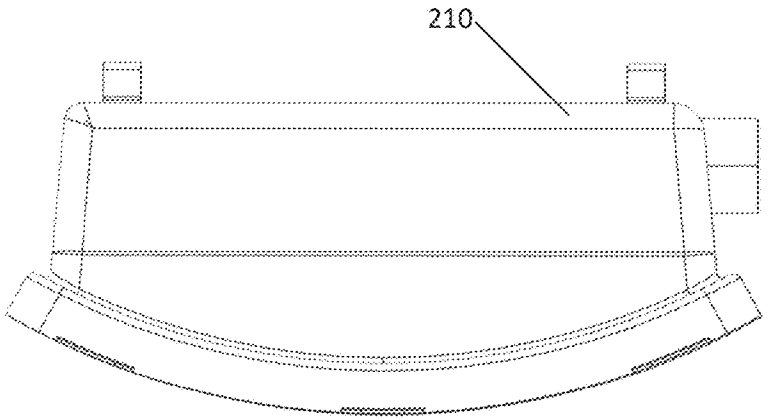
FIG. 32 is a top view of the burner housing shown in FIG. 28.
Figure 33:
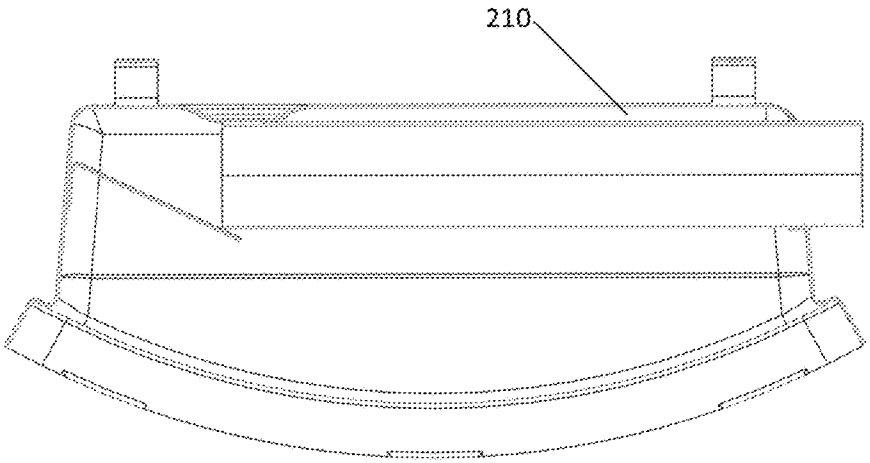
FIG. 33 is a top cross-sectional view of the heating element shown as part of the burner assembly in FIG. 28.
Figure 36:
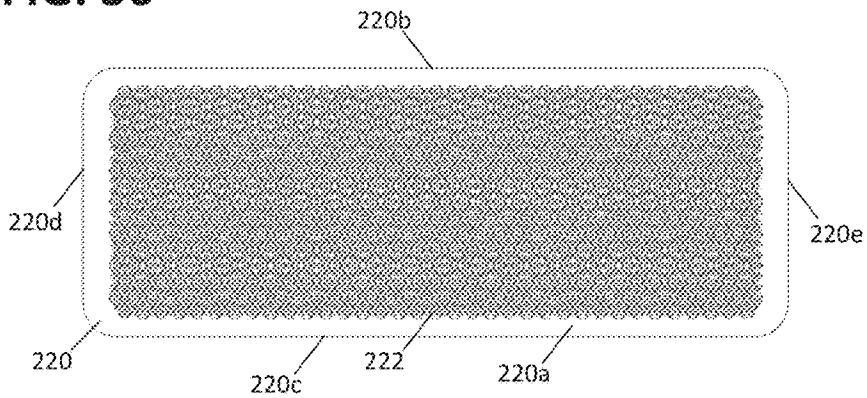
FIG. 36 is a front view of the heating element shown in FIG. 34.
Figure 37:
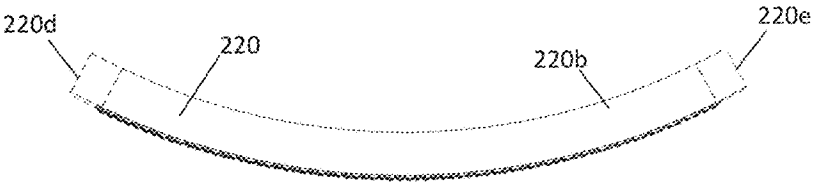
FIG. 37 is a top view of the heating element shown in FIG. 34.

The housing 100 is also shown as including a handle 160 rotatably mounted to the first and second side parts 130, 140. Referring to FIGS. 26 and 27, the first and second side parts 130, 140 are shown in isolation, where it can be seen that the side parts 130, 140 include a cylindrical protrusion 132, 142. The handle 160 is provided with arms 162 defining recesses 164 which receive the protrusions 132, 142. In one example, the arms 162 are elastically deflectable such that the handle 160 can be snapped onto the protrusions 132, 142. Although the handle 160 is provided with recesses and the side parts 130, 140 are provided protrusions, a reverse arrangement in which the handle 160 is provided with protrusions and the side parts 130, 140 are provided with recesses is also possible.

Figure 23:
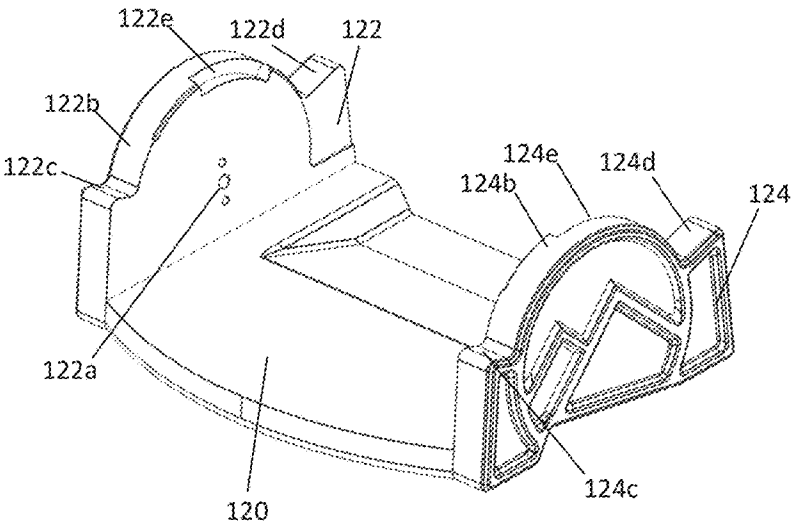
FIG. 23 is a front perspective view of a base of the portable heater shown in FIG. 1.
Figure 24:
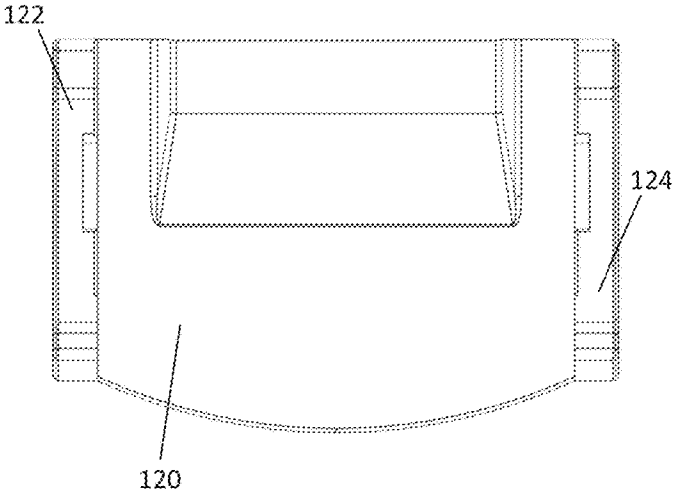
FIG. 24 is a top view of the base shown in FIG. 23.
Figure 25:
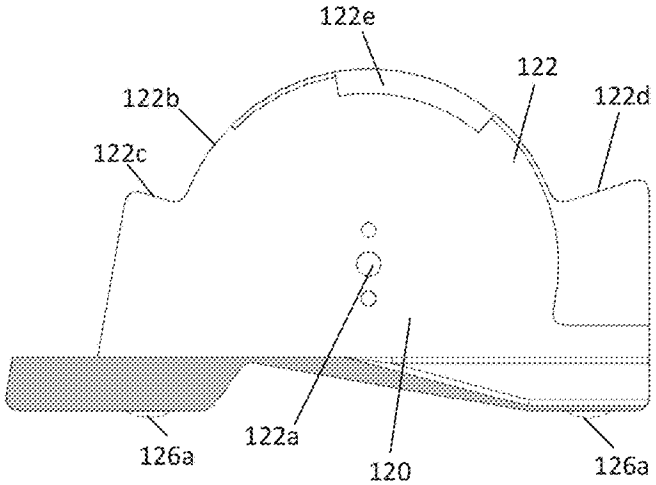
FIG. 25 is a cross-sectional side view of the base shown in FIG. 23.

Referring to FIGS. 23 to 25, the base 120 is shown in isolation. As shown, the base 120 includes a first side wall 122 or and a second side wall 124 extending upwardly from a base wall 126. As shown, the base wall 126 may be provided with feet 126*a* or other structures to enable the base 120 to sufficiently rest on a floor-type surface. As shown at FIGS. 7 to 10, the feet 126*a*, which represent the bottom-most portion of the base 120, extend to a common plane X, which can be, for example, a horizontal floor-type surface. In one aspect, the side walls 122, 124 are each provided with an inwardly facing recess 122*a*, 124*a* for receiving a fastener or pin 182 of a positioning arrangement 180. As most easily seen at FIGS. 17 to 20, the fastener or pins 182 extend through apertures 112*c*, 112*d* in the side walls 112*a*, 112*b* of the main frame 112. Accordingly, the fasteners or pins 182 define a pivot axis X3 about which the main frame 112, and thus the entire enclosure 110, pivots with respect to the base 120.

With continued reference to FIGS. 23 to 25, the side walls 122, 124 are each provided with a curved guide surface 122*b*, 124*b* extending between a first stop surface 122*c*, 124*c* and a second stop surface 122*d*, 124*d*. The side parts 130, 140 are provided with corresponding features and also include a curved guide surface 134*a*, 144*a*, a first stop surface 134*b*, 144*b*, and a second stop surface 134*c*, 144*c*. Accordingly, when the heater 10 is fully assembled, and the enclosure 110 is being rotated with respect to the base 120, the curved guide surfaces 134*a*, 144*a* ride along the curved guide surfaces 122*b*, 124*b* of the base 120. In certain examples, the guide surfaces 134*a*, 144*a* are slightly spaced from the curved guide surfaces 122*b*, 124*b*. However, the guide surfaces 122*b*, 124*b* can be in sliding contact with each other, if desired.

Figure 7:
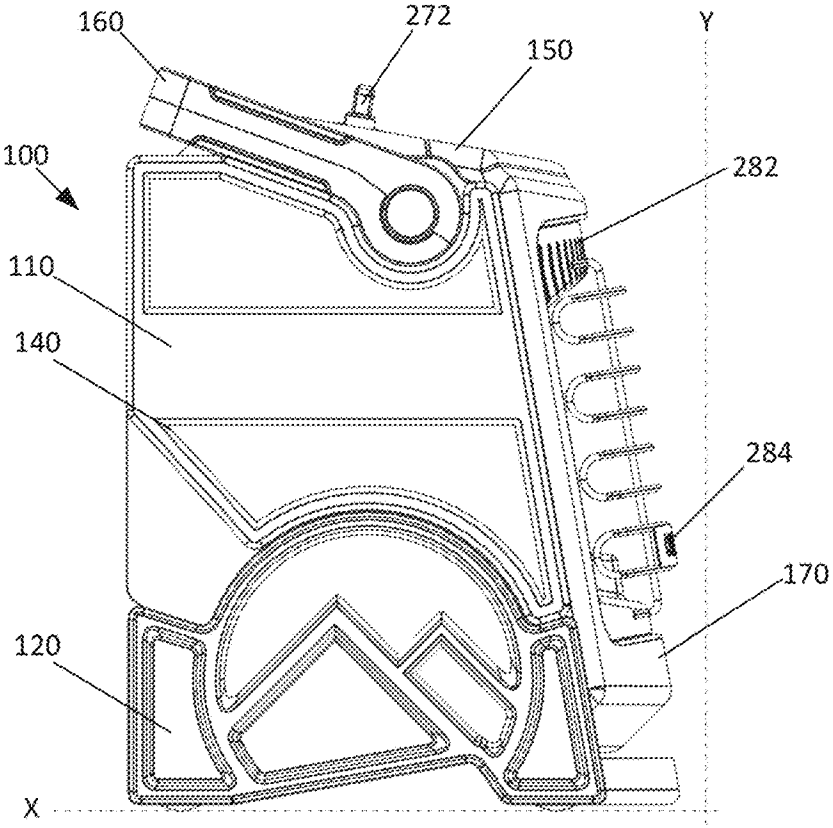
FIG. 7 is a side view of the portable heater shown in FIG. 1, with the heater in a first position.

As can be seen at FIGS. 7 and 8, the enclosure 110 can be said to be in a first rotational position in which the first stop surfaces 134*b*, 144*b* of the side parts 130, 140 contact the first stop surfaces 122*c*, 124*c* of the base 120 such that further rotation in that direction is not possible. In this first rotational position, it can be seen at FIG. 8 that a heating surface 220*a* of a heating element 220 is disposed at a first angle A1 to a plane Y which is orthogonal to the plane X. The first angle A1, defined by the first stop surfaces, can be any desired angle, for example 0 degrees, 10 degrees, 20 degrees, or more. In the particular example shown, the angle A1 is about 10 degrees.

Figure 9:
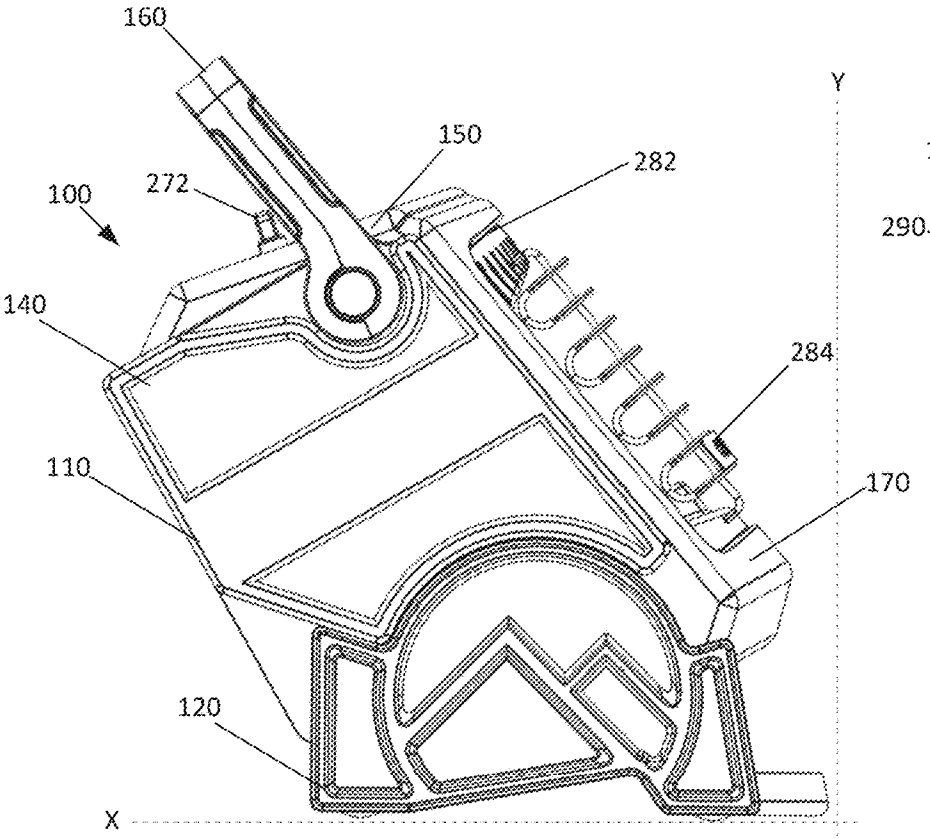
FIG. 9 is a side view of the portable heater shown in FIG. 1, with the heater in a second position.

As can be seen at FIGS. 9 and 10, the enclosure 110 can be said to be in a second rotational position in which the second stop surfaces 134*c*, 144*c* of the side parts 130, 140 contact the second stop surfaces 122*d*, 124*d* of the base 120 such that further rotation in that direction is not possible. In this second rotational position, it can be seen at FIG. 10 that the heating element heating surface 220*a* is disposed at a second angle A2 to the plane Y. The second angle A2, defined by the second stop surfaces, can be any desired angle, for example 30 degrees, 40 degrees, 60 degrees, or more. In the particular example shown, the angle A1 is about 50 degrees, whereby the angle between the first and second rotational positions is about 40 degrees.

Figure 21:
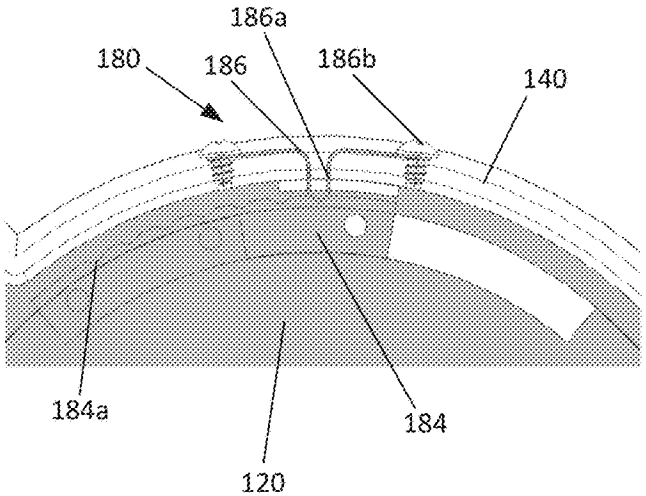
FIG. 21 is an enlarged cross-sectional view of the housing view shown in FIG. 20.
Figure 22:
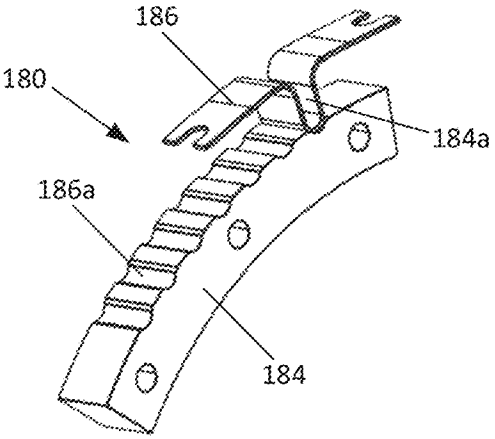
FIG. 22 is an enlarged partial perspective view of a portion of the housing shown in FIG. 20.
Figure 20:
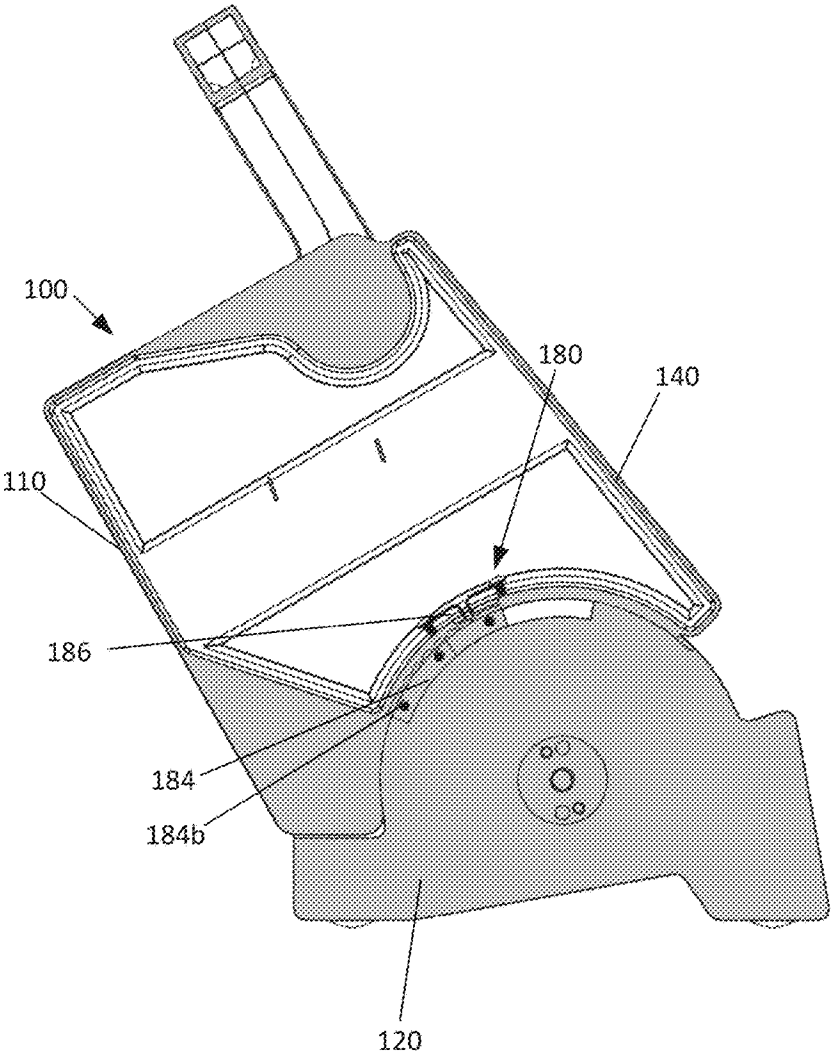
FIG. 20 is a cross-sectional view of the housing shown in FIG. 17.

Referring to FIGS. 20 to 22, a positioning arrangement 180 is provided to enable the enclosure 110 to be indexed into discrete positions between the first and second rotational positions. In one aspect, the positioning arrangement 180 includes a first part 184 secured to the base 120 and a second part 186 secured to the first side part 130 and/or the second 140. In the example shown, a positioning arrangement 180 is provided on each side of the enclosure 110 such that each side wall 122, 124 of the base 120 and each side part 130, 140 are provided with a first part 184 and a second part 186, respectively. However, the positioning arrangement 180 may be provided on only one side, if desired. In one aspect, the first part 184 is mounted into a recess 122*e*, 124*e* of the side walls 122, 124 and secured with fasteners 184*b* while the second part 186 is mounted to the first and second parts 130, 140, secured with fasteners 186*b*, such that a portion of the second part 186 extends through an aperture 134*d*, 144*d* in the guide surfaces 134*a*, 144*a*. As most easily viewed at FIG. 22, the second part 186 is configured with a flexible metal spring clip portion 186*a* that extends into recesses 184*a* defined within the first part 184. Accordingly, as the enclosure 110 rotates with respect to the base 120, the spring clip portion 186*a* snaps into and out of the recesses 184*a*, whereby the enclosure 110 can be held or retained in an indexed position between the first and second rotational positions. As noted previously, the guide surfaces of the base 120 and first and second side parts 130, 140 can be configured to be in contact with each other, such that friction can be used to retain the enclosure 110 in a given rotational position without the use of a positioning arrangement 180. In such a case, the enclosure 110 can be characterized as being infinitely adjustable.

In one aspect, the heater 10 can include a tilt switch 190. The tilt switch 190 is a safety element that can be used to shut the gas valve of the burner assembly 200 in cases where the heater 10 is tipped past a certain point, such as tipping forward onto the front face or sideways. In such instances, an adjacent surface could be otherwise burned or ignited from the flame of the burner assembly without the inclusion of the tilt switch 190. In operation, the tilt switch 190 acts as a relay in the electrical activation circuit of the burner assembly such that, when tipped, the tilt switch 190 opens and breaks the electrical circuit required for normal operation of the control valve. In the example presented, the tilt switch 190 is mounted to the base 120 through an arc-shaped opening 112*e* in the sidewall 112*b* of the main frame 112. Accordingly, and as can be seen at FIGS. 8 and 10, the position of the tilt switch 190 is advantageously unaffected by the rotation of the enclosure 110 between the first and second rotational positions. As the enclosure 110 is rotated, the arch-shaped opening 112*e* enables the enclosure 110 to rotate without being inhibited by the mounting of the tilt switch 190 to the base 120 while still allowing for the tilt switch 190 to be located within the interior of the enclosure.

The heater 10 can also be mounted to a vertical surface, such as a wall, in certain installations. To facilitate such a configuration, the side parts 130, 140 are provided with keyhole type slots 136, 146 such that screw heads, or other types of fasteners, secured to the wall, can be received to support the heater 10.

Burner Assembly 200

As most easily seen at FIGS. 11 to 16, the burner assembly 200 can include a burner housing 210 that receives a heating element 220 defining an outer heating surface 220*a*, shown in the drawings as being a ceramic plaque 220. The burner assembly 200 can further include a control valve assembly 230 having a control knob 232, a pilot light assembly 240, and a pressure regulator/attachment assembly 250 for providing fuel to the burner housing 210 via an attached fuel tank 20. As shown, the pilot light assembly 240 is mounted to the front side of the burner housing 210 and connected to the control valve assembly 230 via a fuel line 260. A nozzle 264 in the burner tube 266 of the burner housing 210 is connected to the control valve assembly 230 via a fuel line 262 while the regulator attachment assembly 250 is attached to the control valve assembly 230 via a fuel line 263. The burner assembly 200 is further shown as including an ignitor assembly 270, having a button 272, electrically coupled to the pilot light assembly 240.

Figure 11:
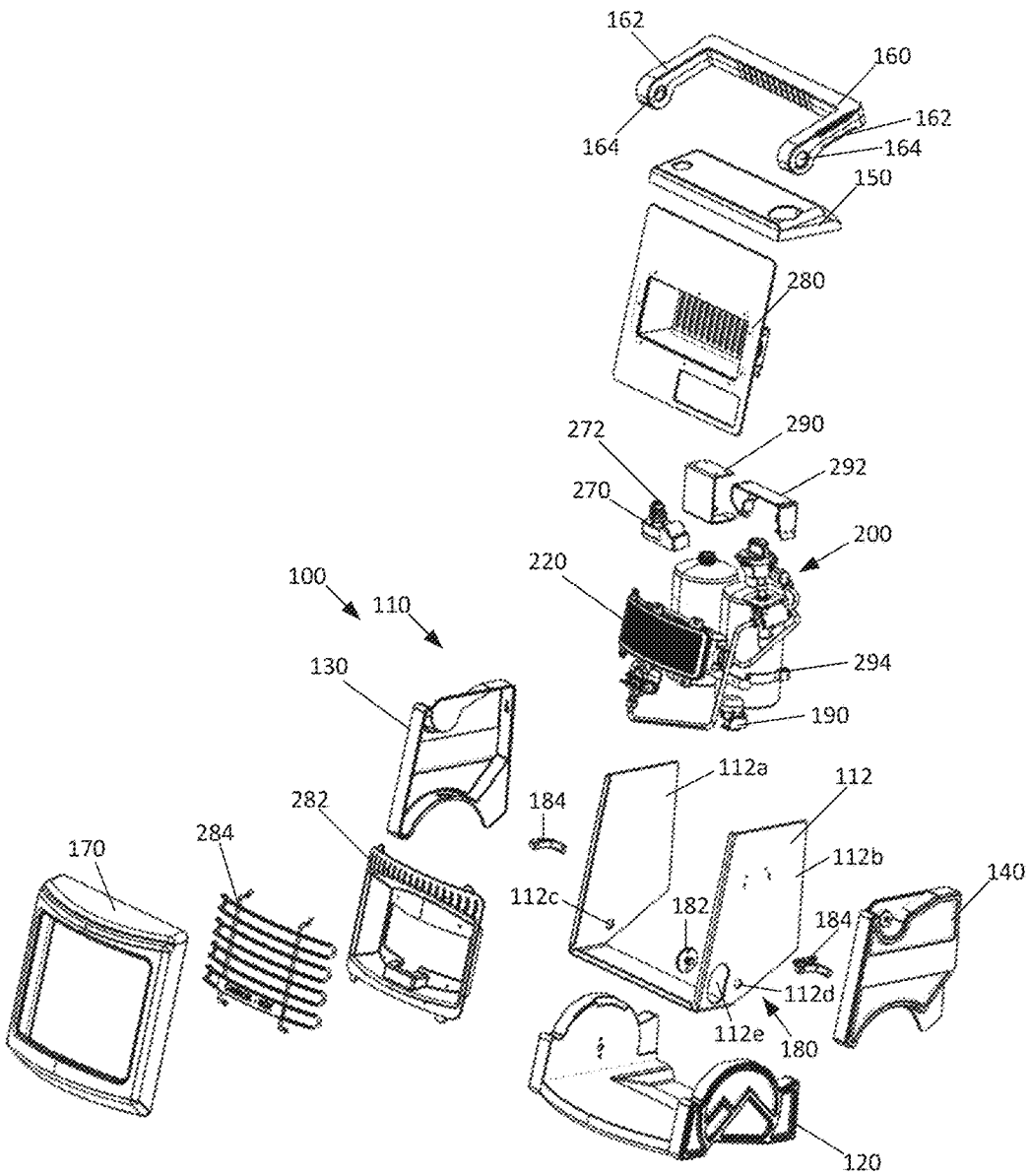
FIG. 11 is a front exploded perspective view of the portable heater shown in FIG. 1.
Figure 12:
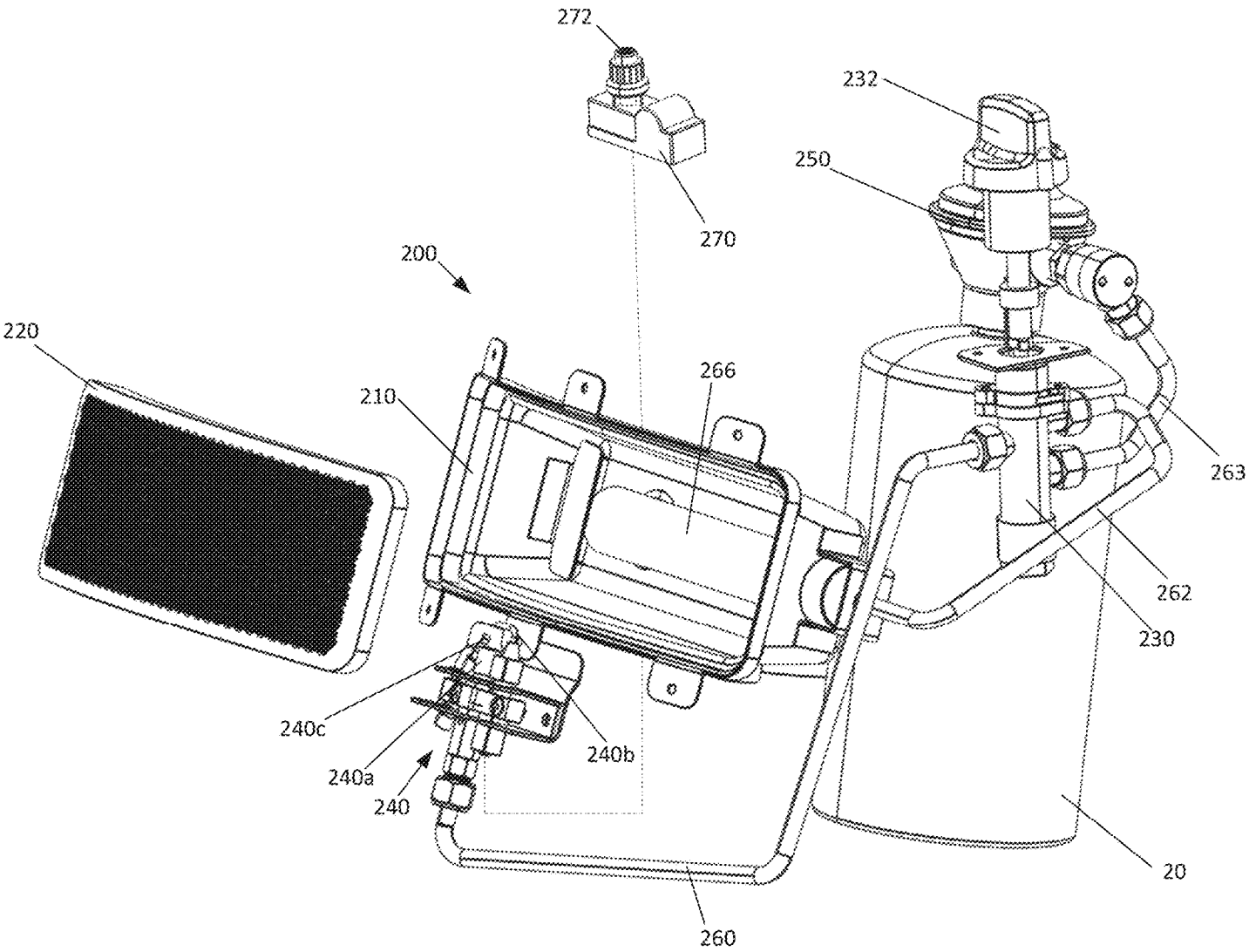
FIG. 12 is a front perspective view of a portion of a fuel and burner assembly of the portable heater shown in FIG. 1, shown with the heating element removed from the burner housing for clarity.
Figure 14:
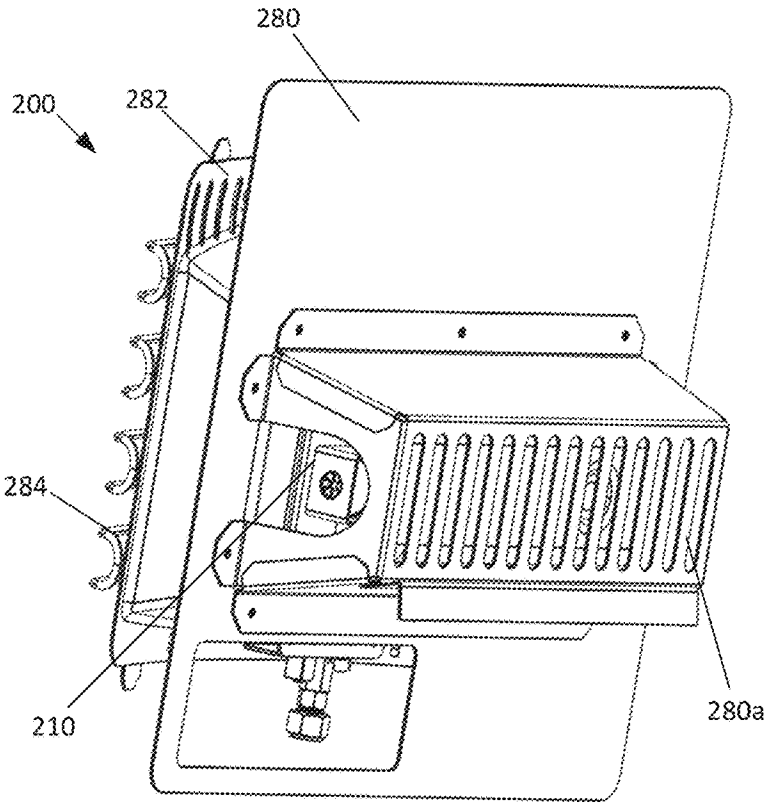
FIG. 14 is a rear perspective view of the portion of the fuel and burner assembly shown in FIG. 12.
Figure 13:
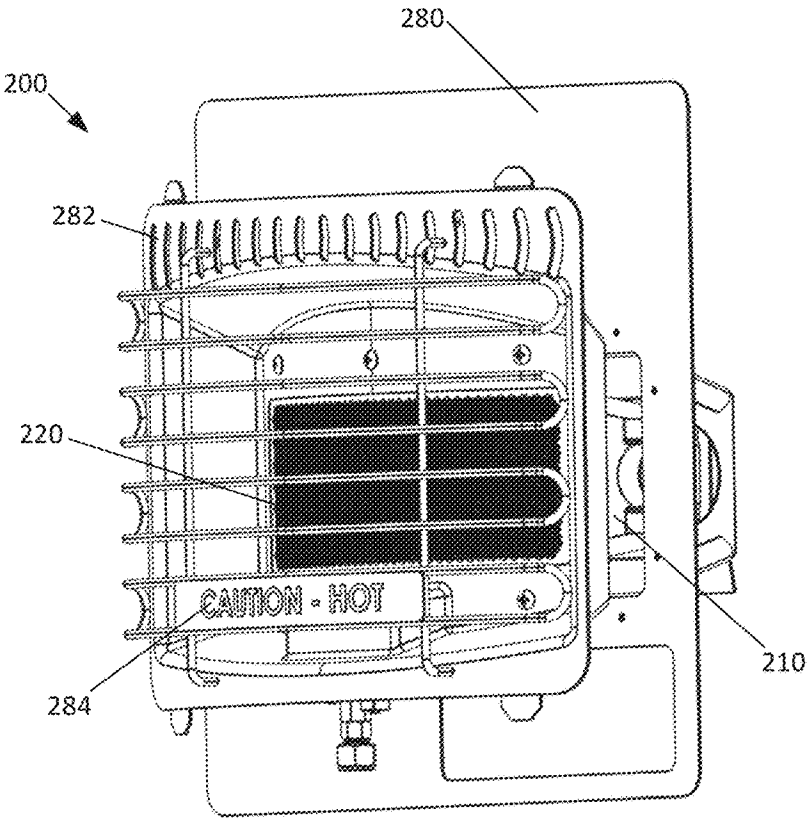
FIG. 13 is a front perspective view of a portion of a fuel and burner assembly of the portable heater shown in FIG. 1.
Figure 16:
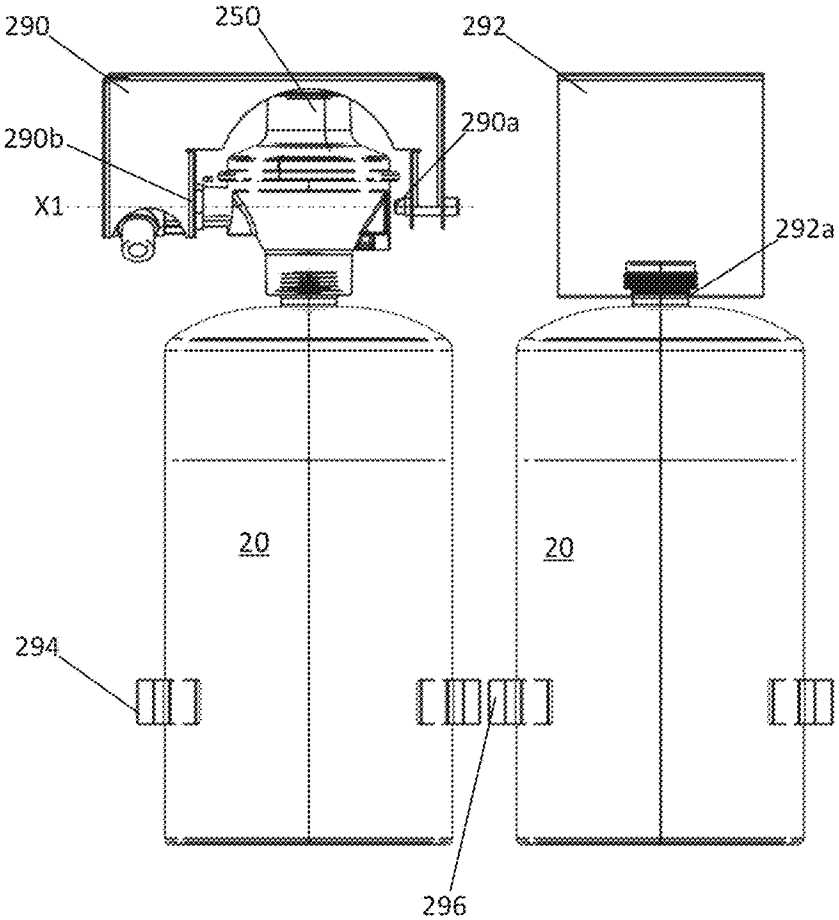
FIG. 16 is a rear view of the portion of the fuel and burner assembly of the portable heater shown in FIG. 15.
Figure 15:
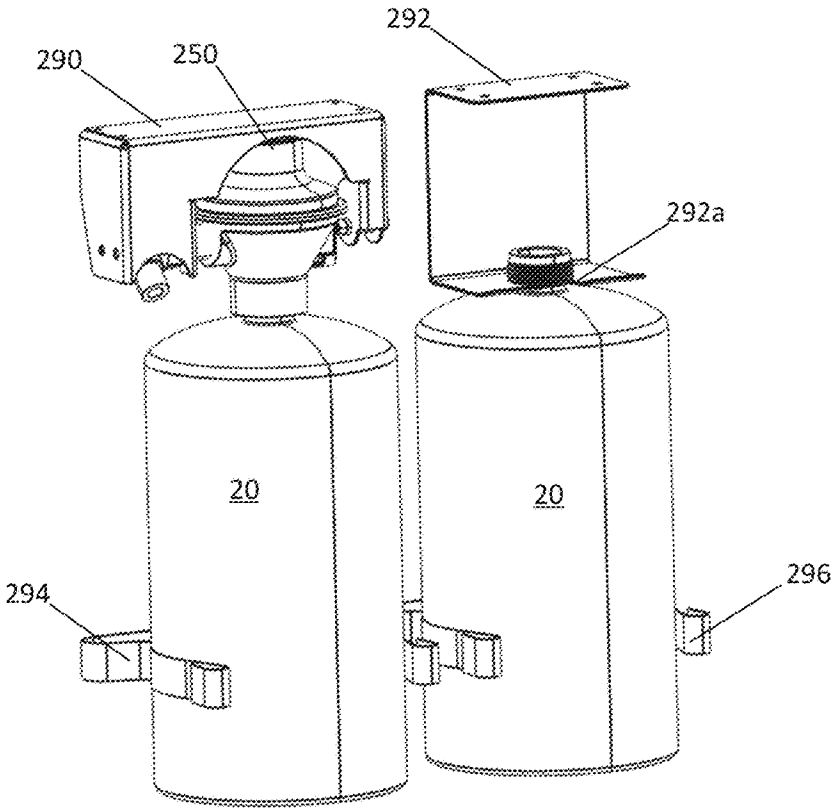
FIG. 15 is a rear perspective view of a portion of the fuel and burner assembly of the portable heater shown in FIG. 11.
Figure 18:
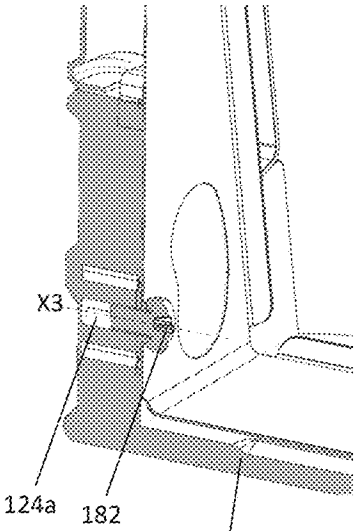
FIG. 18 is an enlarged cross-sectional view of the housing view shown in FIG. 17.
Figure 19:
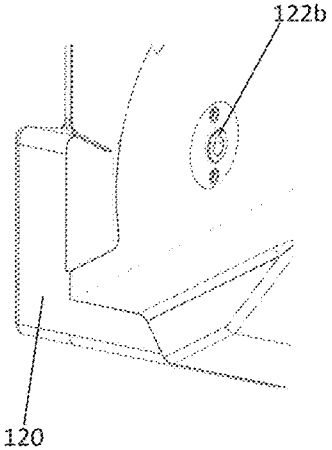
FIG. 19 is an enlarged partial perspective view of a portion of the housing shown in FIG. 17.

As most easily viewed at FIG. 11, the burner assembly 200 can be characterized as further including a heat shield cover panel 280 which receives the burner housing 210 and is mounted to the main frame 112. In one aspect the heat shield cover panel 280 radiates heat to heat the fuel storage tanks 20. The heat shield cover panel is further provided with apertures 280*a* in a rear portion facing the tanks 20, which allows for heated air to be provided to the tanks 20 via convection. These features allow heat generated at the back side of the burner housing 210, which can be characterized as waste heat, to keep the tanks 20 at a better temperature for normal operation. With such a construction, a far greater percentage of the available fuel in the tank 20 can be utilized in relatively cold conditions, in comparison to a configuration in which no significant heating is provided to the tanks. The burner assembly 200 is also shown as including a front heat shield 282 which surrounds the heating element 220 and is attached to the burner housing 210 with fasteners, such as screws. The front heat shield 282 is reflective and aids in directing radiated heat from the heating element 220 outwardly. A front guard 284 is also shown as being provided and attached to the front heat shield 282.

The burner assembly 200 is further shown as being provided with various structures for holding the fuel tanks 20 within the enclosure 110. In one aspect, a first mounting bracket 290 and a second mounting bracket 292 are provided, both of which are mounted to the top part 150 and within the enclosure 110. As most easily seen at FIG. 15, the first mounting bracket 290 rotatably secures the gas pressure regulator 250, via a pin 290*a* extending into the regulator 240 and a recess 290*b* receiving a fitting or portion of the regulator 240, such that the regulator 240 and an attached fuel tank 20 can rotate about an axis X. Such a feature is useful when threading the fuel tank 20 onto or off of the corresponding threads of the gas pressure regulator 250, as the pivoting function allows the fuel tank 20 can be held at an angle and thus partially extending outside of the interior space of the enclosure 110. Once the fuel tank 20 is fully threaded onto the regulator 240, the fuel tank 20 can be rotated to be fully inside the enclosure, as is illustrated in the drawings. To retain the fuel tank 20 in this position, a retaining clip 294 can be provided that engages with the sidewall of the fuel tank 20. In the example shown, the retaining clip 294 is mounted to the back side of the heat shield cover panel 280 with fasteners. The second mounting bracket 292 is shown as being located to the side of the first mounting bracket 290 and is similarly mounted to the top part 150. However, the second mounting bracket 292 is provided with a recess or slot 292*a* for receiving a neck portion of the fuel tank 20 such that the fuel tank 20 can hang from the second mounting bracket 292. To further aid in retaining the fuel tank 20 in this position, a retaining clip 296, similar to retaining clip 294, may be provided and similarly mounted to the rear side of the heat shield cover panel 280. Variations are possible. For example a magnet 295, schematically shown at FIGS. 8 and 10, could be mounted to the enclosure 110 to secure the fuel tank 20 in addition to or instead of using a retaining clip 294.

To operate the burner assembly 200, an operator turns the knob 232 of the control valve assembly 230 to a first position to enable gas to flow from the fuel tank 20 to the pilot light assembly 240. The operator then depresses the ignitor assembly button 272 which provides a spark at the location of the pilot light assembly 240, via an ignitor 240*b*, to ignite the fuel emitting from a gas port 240*a* of the pilot light assembly 240. Once the pilot light is established, the knob 232 can be rotated to a second position to enable gas to flow from the control valve 230 to the nozzle 265 located in the burner housing 210. The pilot light flame then ignites fuel emanating from the burner plaque 220 once sufficient fuel fills the burner tube 266 and housing 210. In the example shown, the pilot light assembly 240 is provided with a thermocouple 240*c* that senses the temperature of the pilot light flame to indirectly assess oxygen levels of the ambient air surrounding the heater 10. When the temperature is sensed to be below a threshold level, indicating insufficient oxygen levels and thus potentially high carbon monoxide levels, the burner assembly 200 can shut fuel flow off from the fuel tank 20 to the burner housing 210 and pilot light assembly 240. In one example, the control valve 230 has an internal magnetic solenoid valve which is powered by the thermocouple 240*c*. When the user pushes down on the control valve knob 232, the solenoid is overridden in an open position. As the pilot burner heats up the thermocouple 240*c*, the thermocouple 240*c* produces voltage potential that powers the solenoid in an open position allowing gas flow without intervention from the user. If the pilot is extinguished or the unit is tipped over, the solenoid loses power and the solenoid extends stopping further gas flow. As most easily seen at FIG. 12, the gas port 240*a*, ignitor 240*b*, and thermocouple 240*c* may be secured to a common mounting plate 240*d* which is in turn secured to the burner housing 210.

Heating Element 220

Figure 38:
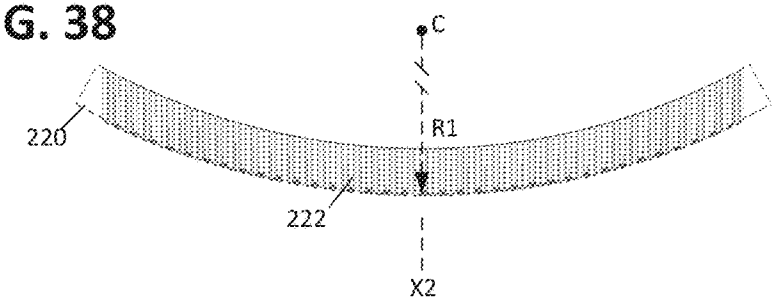
FIG. 38 is a top cross-sectional view of the heating element shown in FIG. 34.
Figure 34:
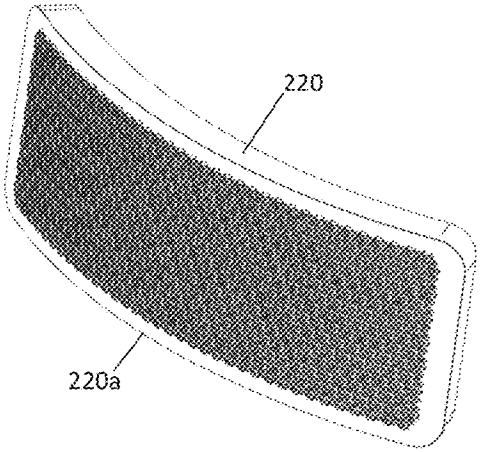
FIG. 34 is a front perspective view of a heating element of the portable heater shown in FIG. 1.
Figure 35:
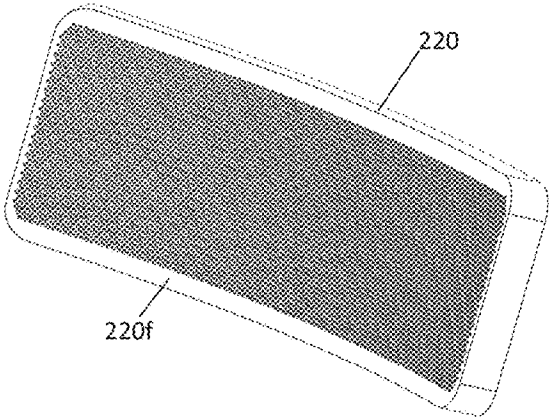
FIG. 35 is a rear perspective view of the heating element shown in FIG. 34.
Figure 40:
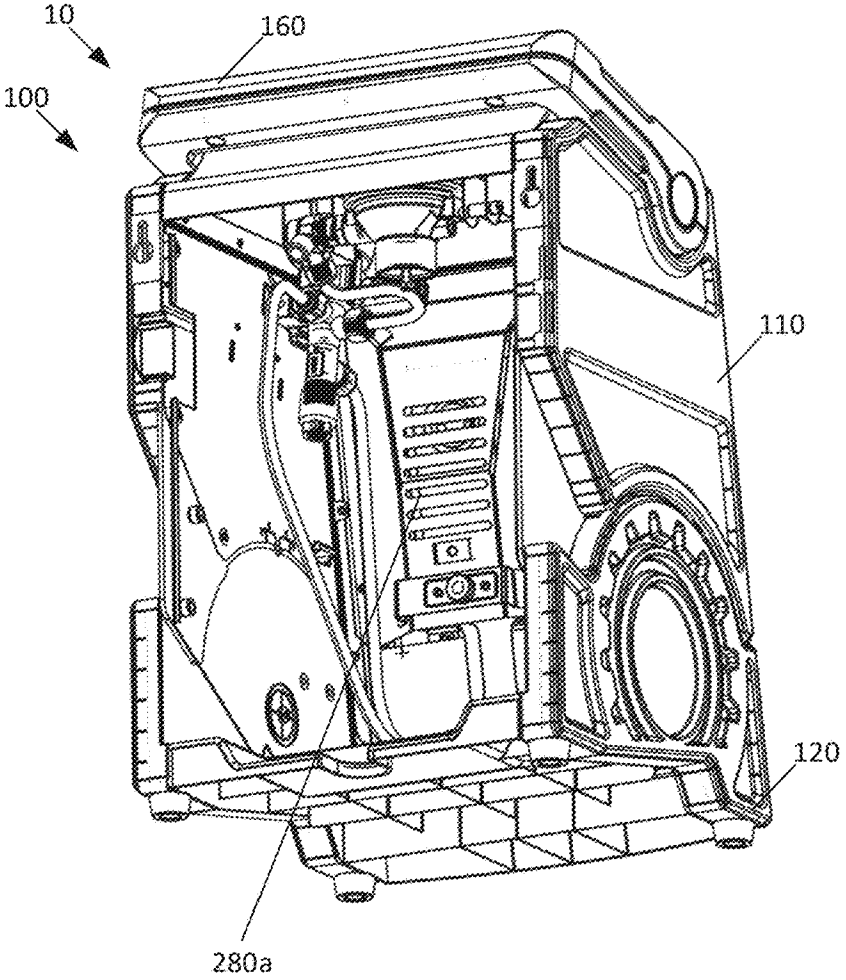
FIG. 40 is a rear perspective view of the portable heater shown in FIG. 39.
Figure 39:
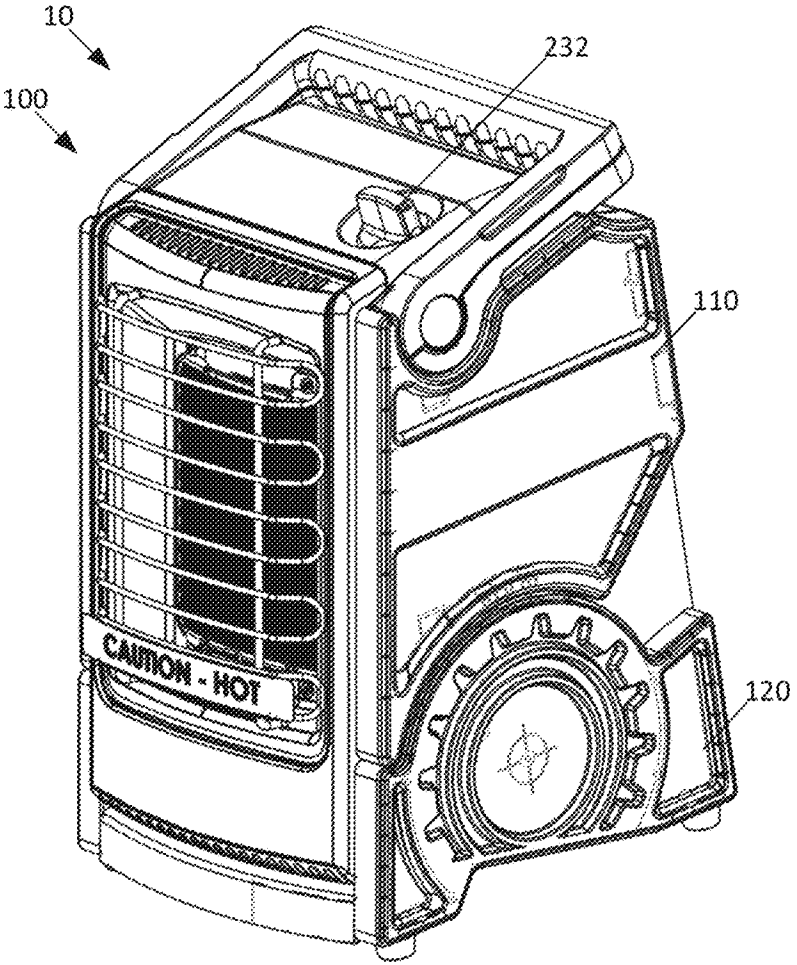
FIG. 39 is a front perspective of portable heater having features in accordance with principles of the disclosure.
Figure 42:
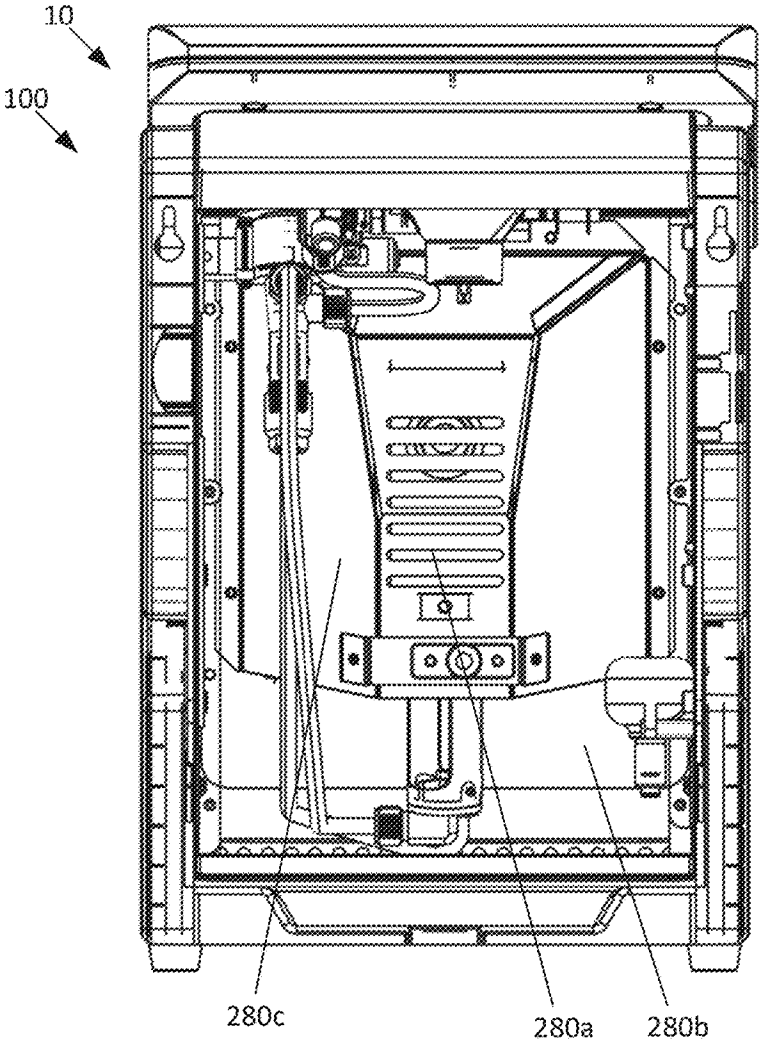
FIG. 42 is a rear view of the portable heater shown in FIG. 39.
Figure 41:
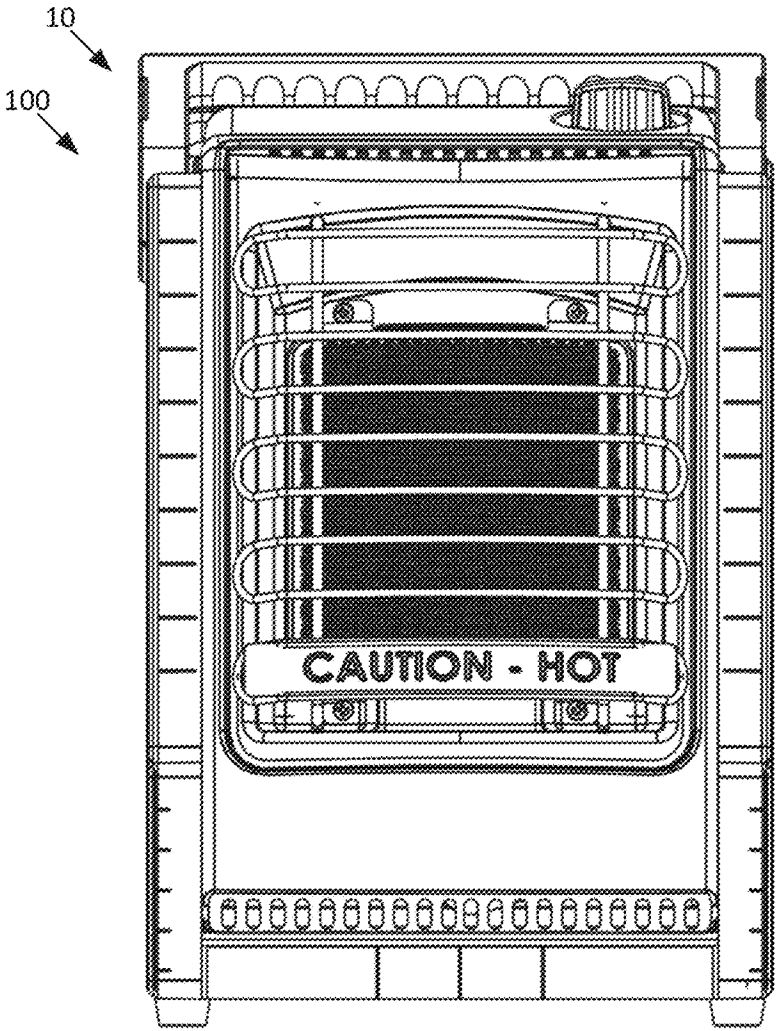
FIG. 41 is a front view of the portable heater shown in FIG. 39.
Figure 44:
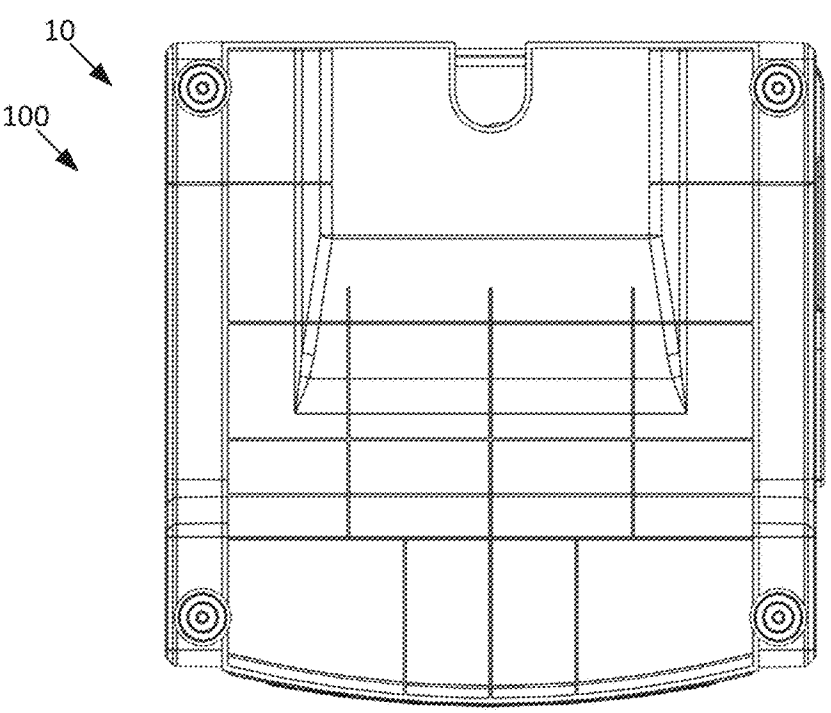
FIG. 44 is a bottom view of the portable heater shown in FIG. 44.
Figure 43:
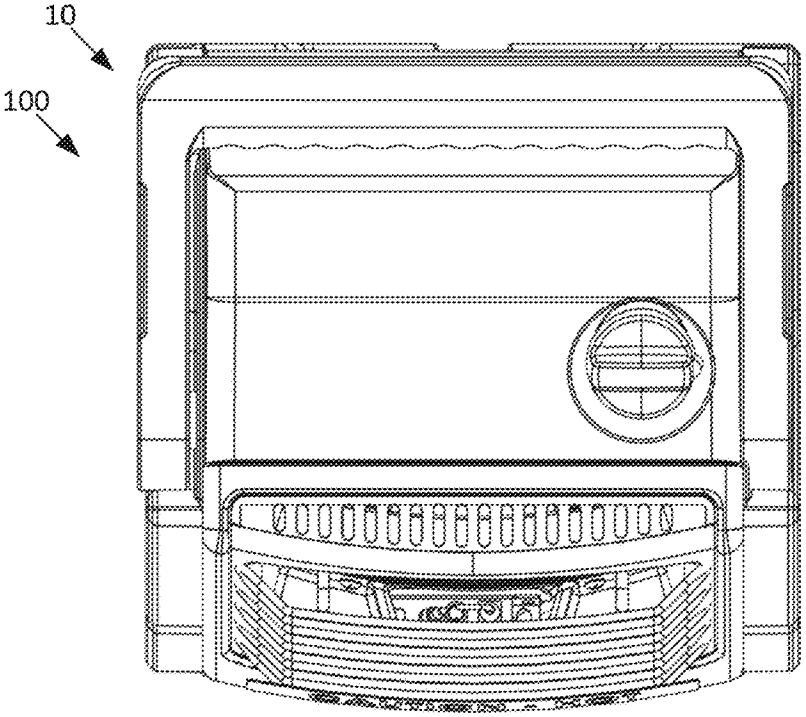
FIG. 43 is a top view of the portable heater shown in FIG. 43.
Figure 46:
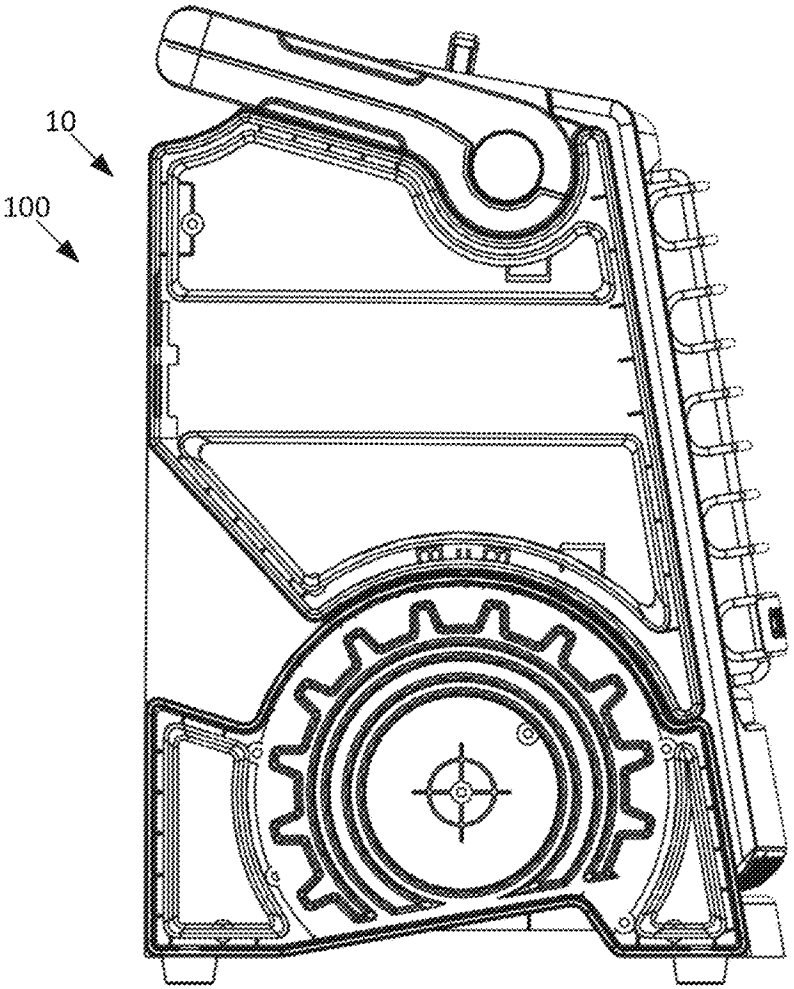
FIG. 46 is a second side view of the portable heater shown in FIG. 39.
Figure 45:
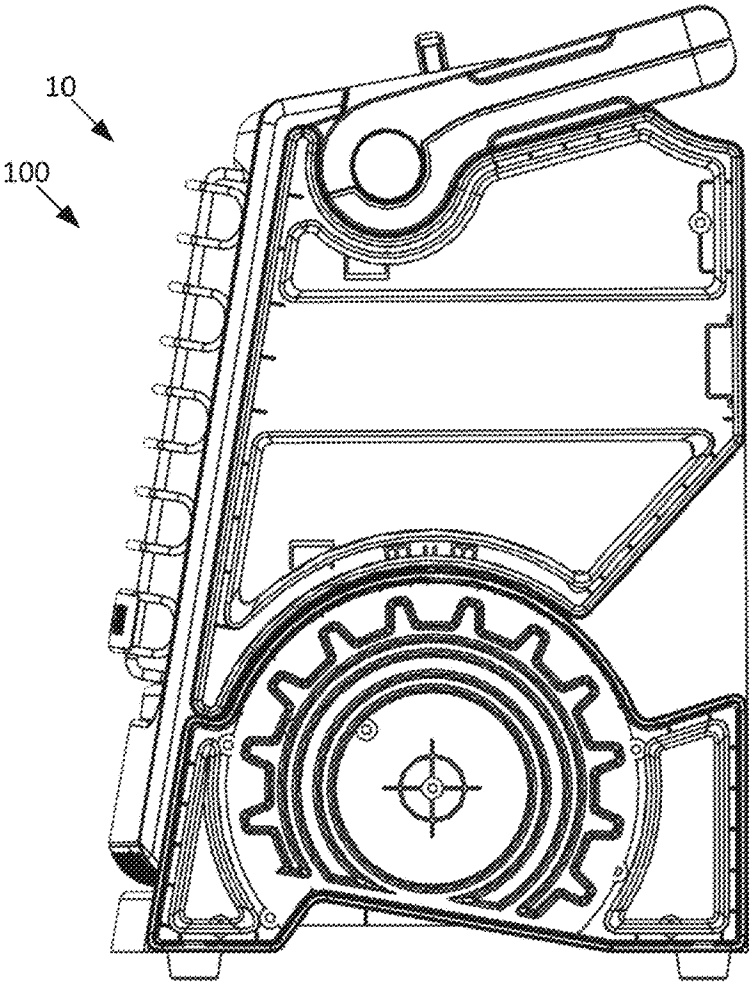
FIG. 45 is a first side view of the portable heater shown in FIG. 39.
Figure 47:
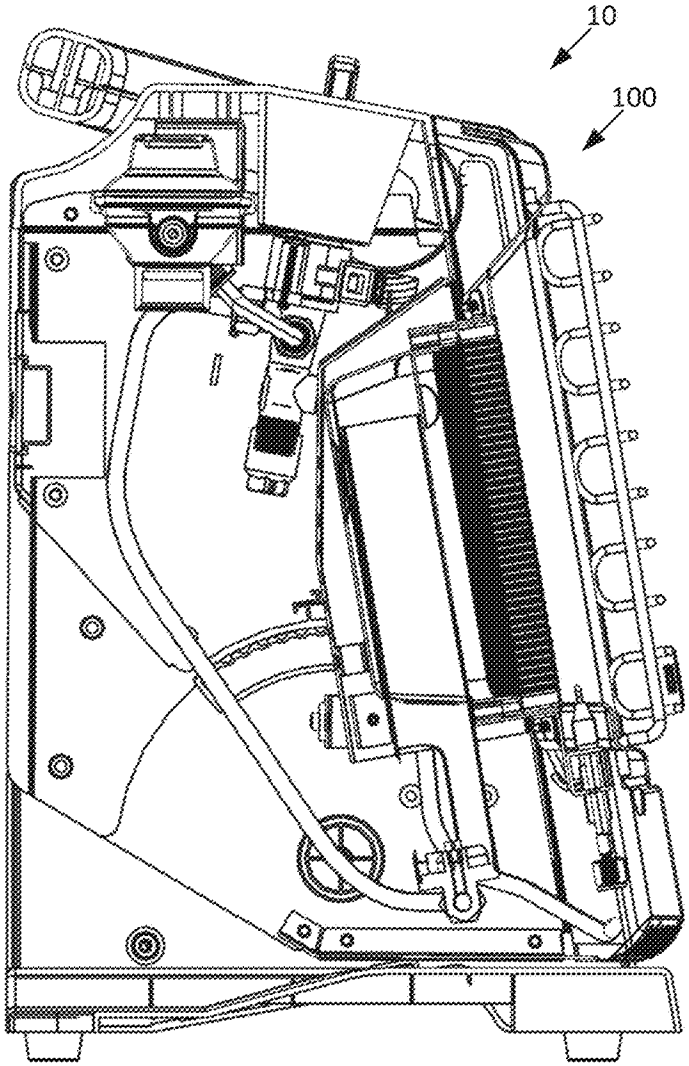
FIG. 47 is a cross-sectional side view of the portable heater shown in FIG. 46.
Figure 48:
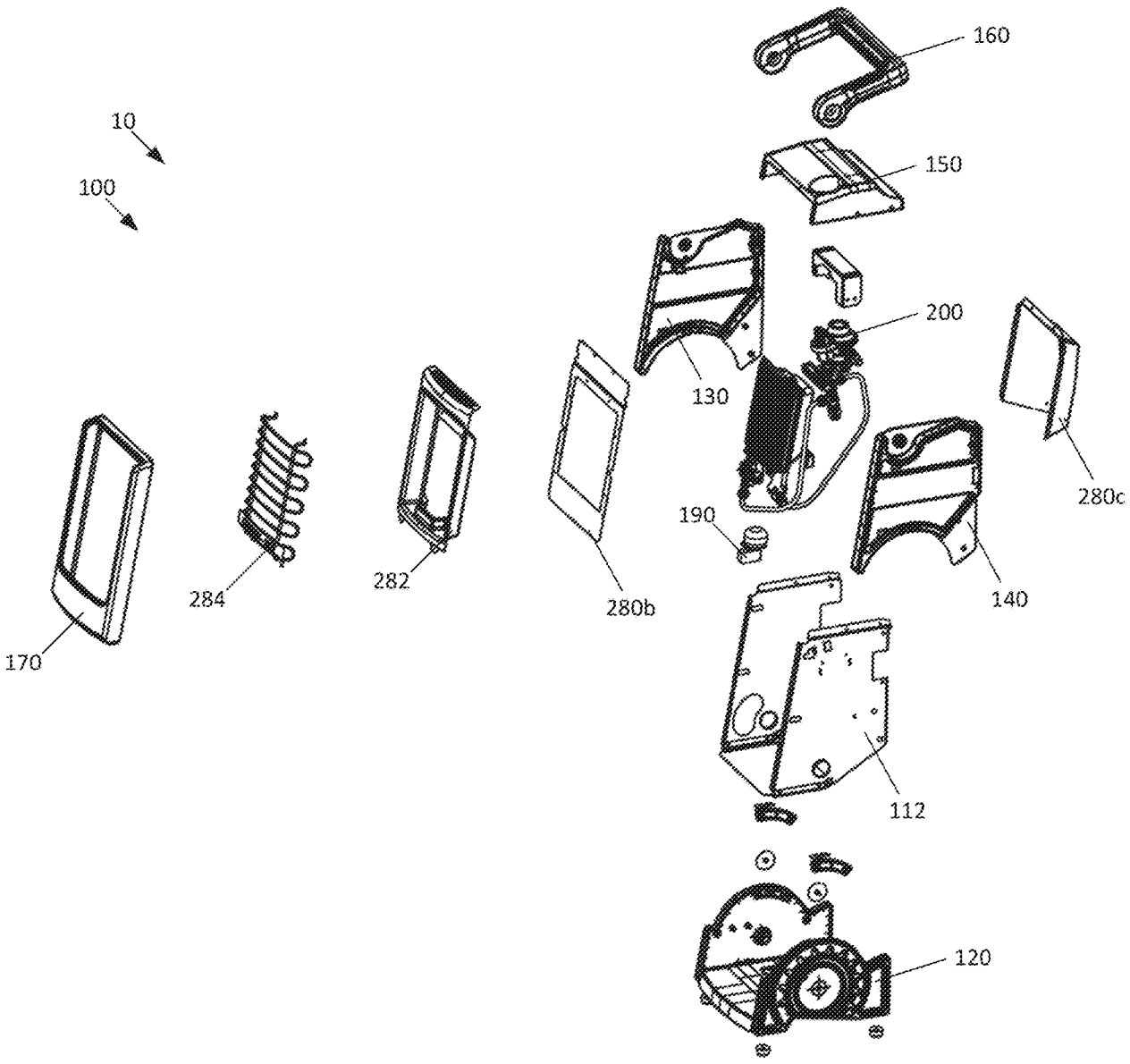
FIG. 48 is an exploded perspective view of the portable heater shown in FIG. 39.

Referring to FIGS. 34 to 38, the heating element 220 is shown in further detail. As presented, the heating element 220 is configured as a ceramic plaque 220 that is curved to present a convex outer surface 220*a*. In the example shown, the outer surface 220*a* is curved in a single direction to have a radius R about a center point C passing through a longitudinal axis X2 of the heating element 220, as illustrated at FIG. 38. The longitudinal axis X2 can also be characterized as being the longitudinal axis for the portable heater 10. As shown, the outer surface 220*a* extends between a top side 220*b*, a bottom side 220*c*, a first side 220*d*, and a second side 220*e*. The heating element 220 also defines an opposite inner surface 220*f* which, in this example, has a curved, concave shape. In one aspect, the curve of the surface 220*a* can be characterized as being a curve formed about a first axis C in a side to side manner (i.e. curved between sides 220*d*, 220*e*). Accordingly, the sides 220*d*, 220*e* are disposed with respect to each other at the same angle. In the example shown, the heating element 220 is curved through an angle between 0 and 90 degrees, and in some examples is curved through an angle between 10 and 60 degrees, and in some examples is curved through an angle between 50 and 60 degrees. In the example shown the heating element 220 is curved through an angle of about 57 degrees.

Although the outer surface 220*a* is curved in only one direction about a single axis, the outer surface 220*a* could be curved about a different axis perpendicular to the first axis such that the outer surface is provided with a top-to-bottom curve (i.e. between top 220*b* and bottom 220*c*) rather than the depicted side-to-side curve. In some examples, the outer surface 220*a* can be curved in both directions. In the example shown, the pores 222 of the heating element 220 at FIGS. 34 to 38 are arranged parallel to each other and with the longitudinal axis X2 of the heating element 220. Accordingly, the centermost pores 222 are generally orthogonal to the outer surface 220*a* proximate the longitudinal axis and are increasingly oblique to the longitudinal axis proximate the sides 220*d*, 220*e*. By use of the term generally orthogonal it is meant to include angles up to and including about 5 to 10 degrees from a completely orthogonal orientation. Such a configuration is advantageous from the perspective that the pores 222 are more easily manufactured into the heating element 220. In the example shown, the heating element 220 is provided with 4,571 pores 212 at an approximate diameter of 1.2 mm. More or fewer pores at a different diameter may be used. The example shown also includes a diamond radiant surface pattern in the outer surface 220*a*.

Other example heating elements usable with the portable heater 10 of the present disclosure are shown and described in U.S. Provisional Patent Application Ser. Nos. 62/916,565 filed on Oct. 17, 2019 and 63/057,629 filed on Jul. 28, 2020, the entireties of which are incorporated by reference herein. In one example disclosed in U.S. Pat. No. '629, the lengths of all of the pores 222 can be disposed orthogonally to the outer surface 220*a*.

Referring to FIGS. 39 to 52, a second example of a portable heater 10 is presented. The portable heater 10 of FIGS. 39 to 52 is generally similar to the portable heater 10 of FIGS. 1 to 38, and includes many of the same features. For example, the portable heater 10 of FIGS. 39 to 52 is fully positionable between first and second rotational positions, is configured with a shaped heat shield having vent openings to safely provide heat to the fuel tank temperature for optimal operation in cold conditions, and has an internally mounted tilt switch that remains in position independent of the rotational position of the housing. Accordingly, the description for the portable heater 10 of FIGS. 1 to 38 is generally applicable to the portable heater of FIGS. 39 to 52, and need not be repeated here. The description for the portable heater 10 of FIGS. 39 to 52 will thus be limited to the primary differences between the presented examples.

In one aspect, the portable heater 10 of FIGS. 39 to 42 is configured with a narrower housing 100 and enclosure 110 such that only a single fuel tank 20 is provided internally and connected to the pressure regulator/attachment assembly 250. This narrower construction is enabled, in part, by a modified burner assembly 200 in which the nozzle 264 and burner tube 266 are oriented in a vertical manner with the gas line 262 entering the bottom of the burner housing 210, as most easily seen at FIG. 49. The burner housing 210 and plaque 220 are also provided with narrower dimensions to accommodate the decreased width of the portable heater 10. The modified burner configuration is also compatible with the portable heater 10 of FIGS. 1 to 38.

In one aspect, the burner assembly 200 is provided with a modified control assembly in which the ignitor assembly button 272 and control valve assembly 230 are integrated into a single unit. Accordingly, the ignitor 240*b* can be activated by depressing the control knob 232 while the pilot light and fuel output to the burner housing 210 can be controlled by rotating the control knob 232. Such a configuration is equally suitable for use with the portable heater 10 of FIGS. 1 to 38.

Figure 50:
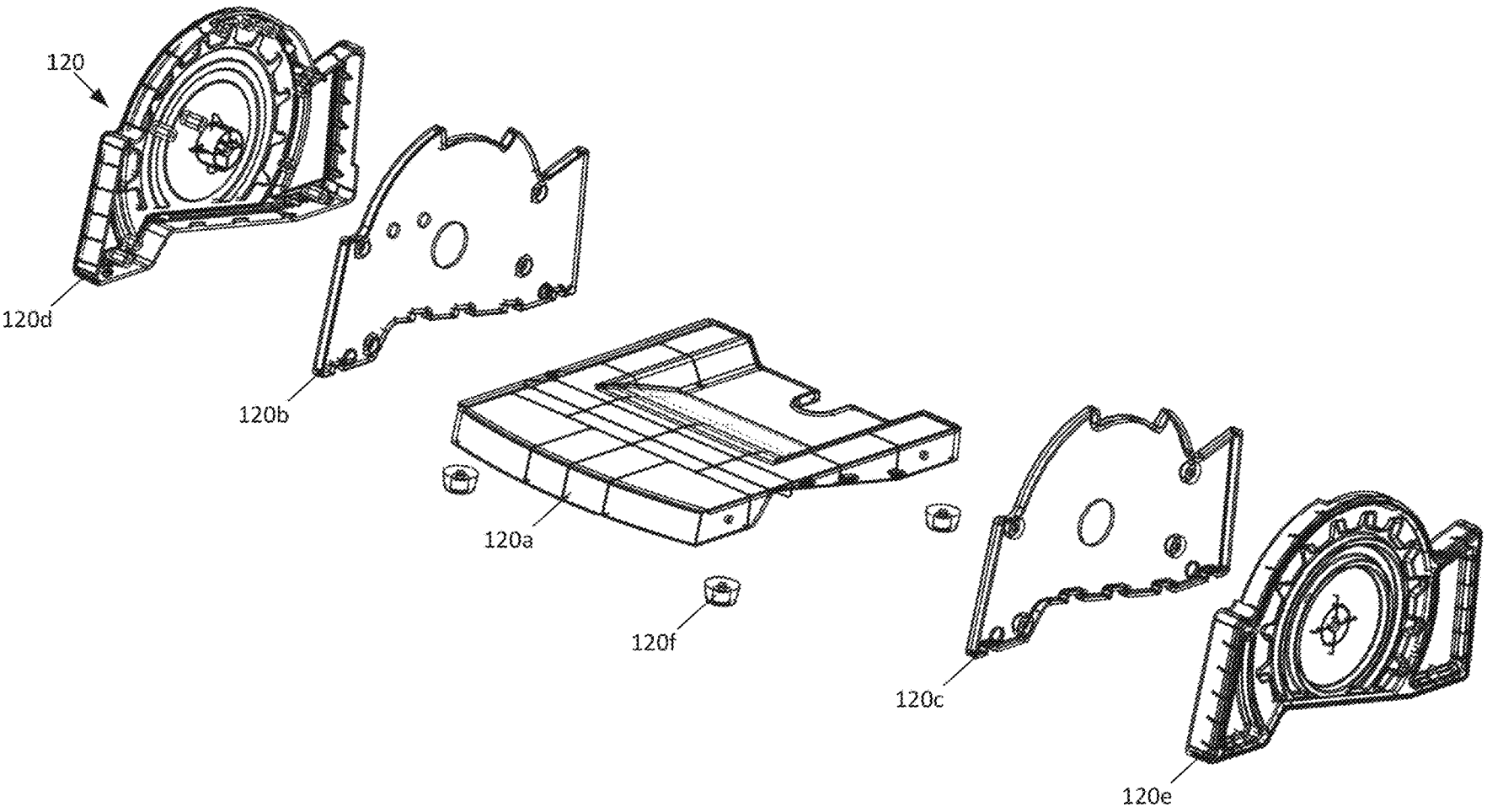
FIG. 50 is an exploded perspective view of a base assembly of the portable heater shown in FIG. 39.

With reference to FIG. 50, it can be viewed that the base 120 is provided as a multi-component assembly secured together with fasteners or snap-fit type features, rather than being formed as a unitary part. As shown, the base 120 is provided with a base portion 120*a* to which first sidewall parts 120*b*, 120*c* are attached. Second sidewall parts 120*d*, 120*e* are attached to the first sidewall parts 120*b*, 120*c*. A plurality of feet 120*f* are also provided and attached to the second sidewall parts 120*d*, 120*e*. Such a configuration advantageously allows for ease and flexibility of manufacturability. Such a configuration is equally suitable for use with the portable heater 10 of FIGS. 1 to 38.

Figure 51:
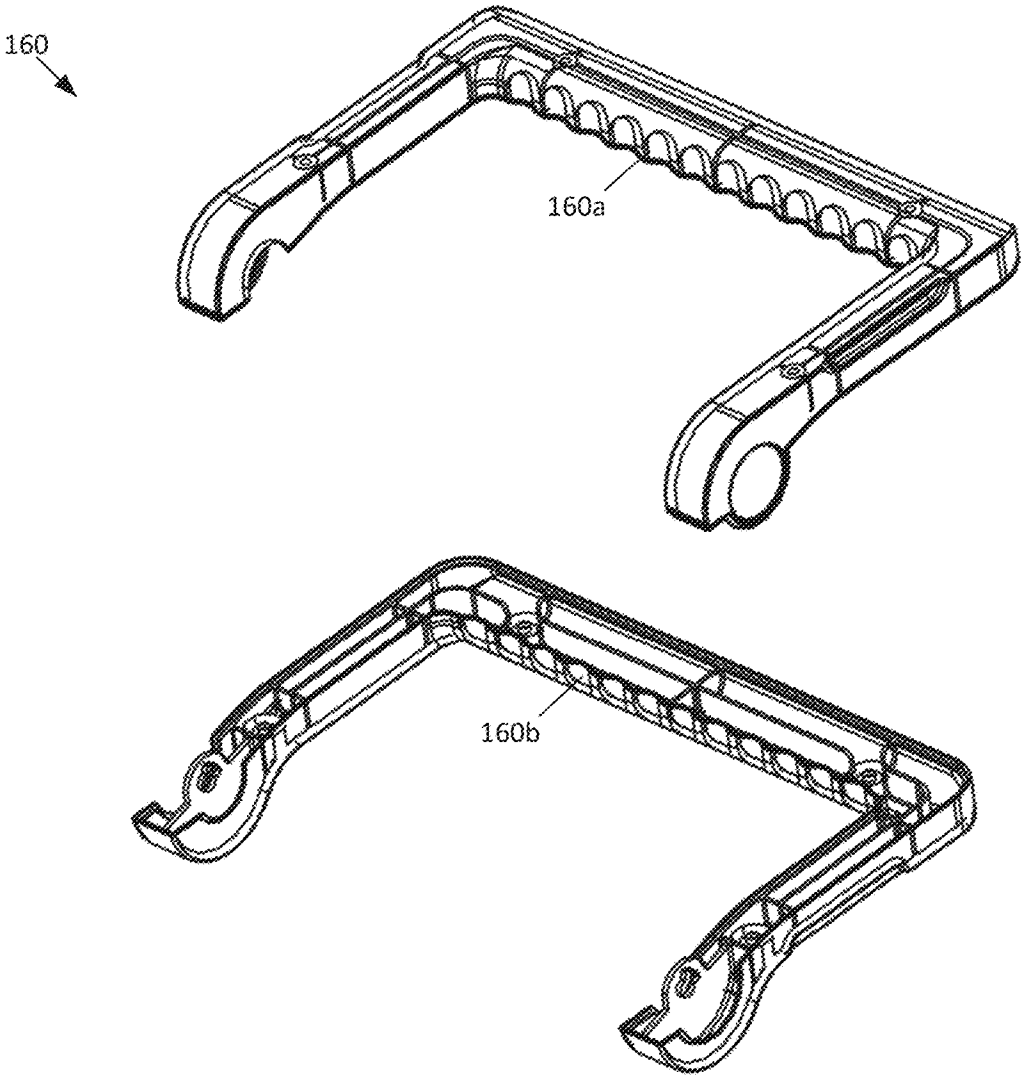
FIG. 51 is an exploded perspective view of a handle assembly of the portable heater shown in FIG. 39.

With reference to FIG. 51, it can be viewed that the handle 160 is provided as a multiple component assembly secured together with fasteners or snap-fit type features, rather than being formed as a unitary part. As shown, the handle 160 is shown as being formed with a first part 160*a* and a second part 160*b*. Such a configuration advantageously allows for ease and flexibility of manufacturability. Such a configuration is equally suitable for use with the portable heater 10 of FIGS. 1 to 38.

Figure 52:
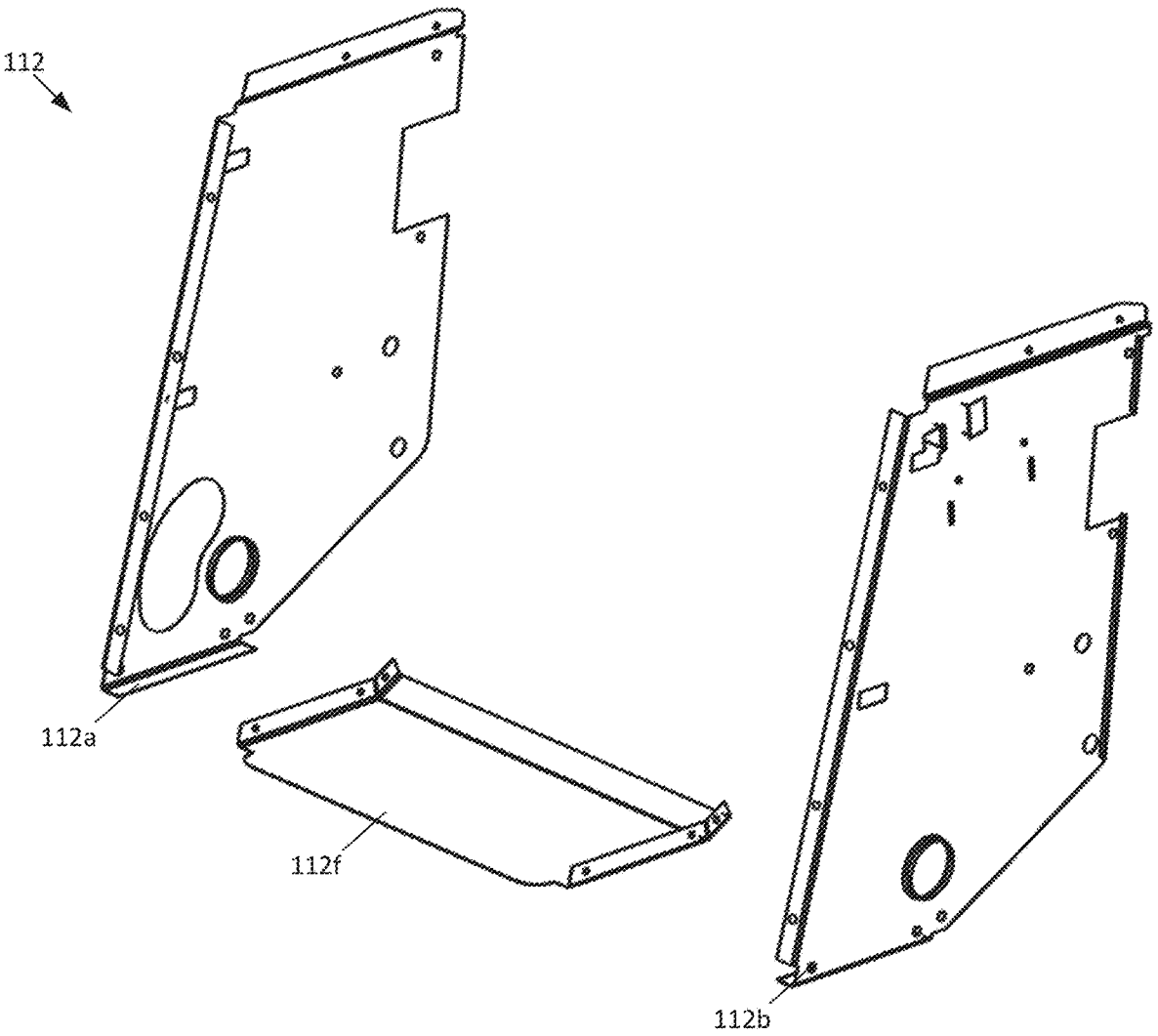
FIG. 52 is an exploded perspective view of a frame assembly of the portable heater shown in Figure.
Figure 54:
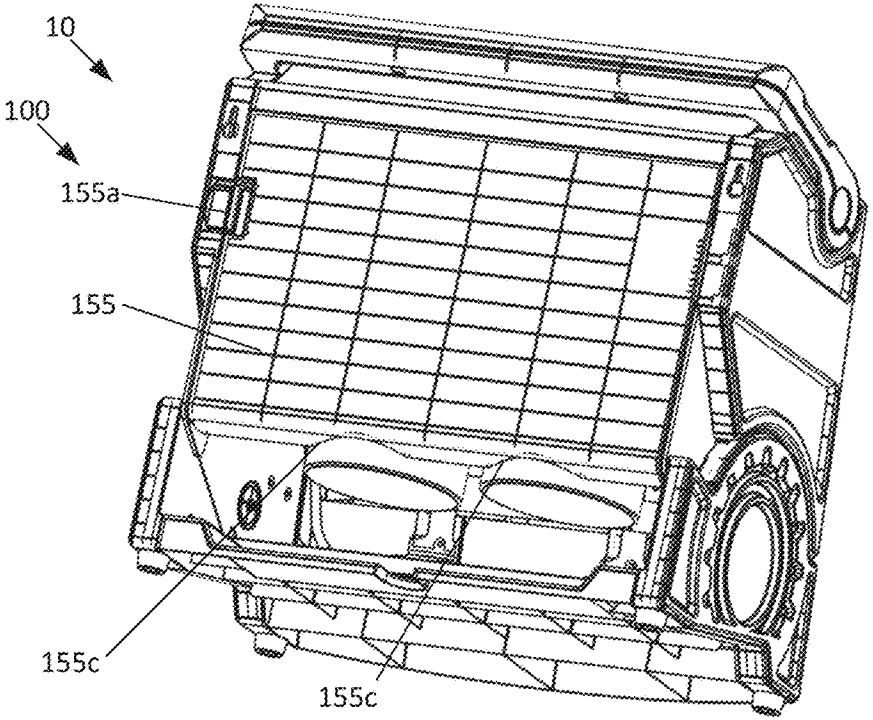
FIG. 54 is a rear perspective view of the portable heater shown in FIG. 53.
Figure 53:
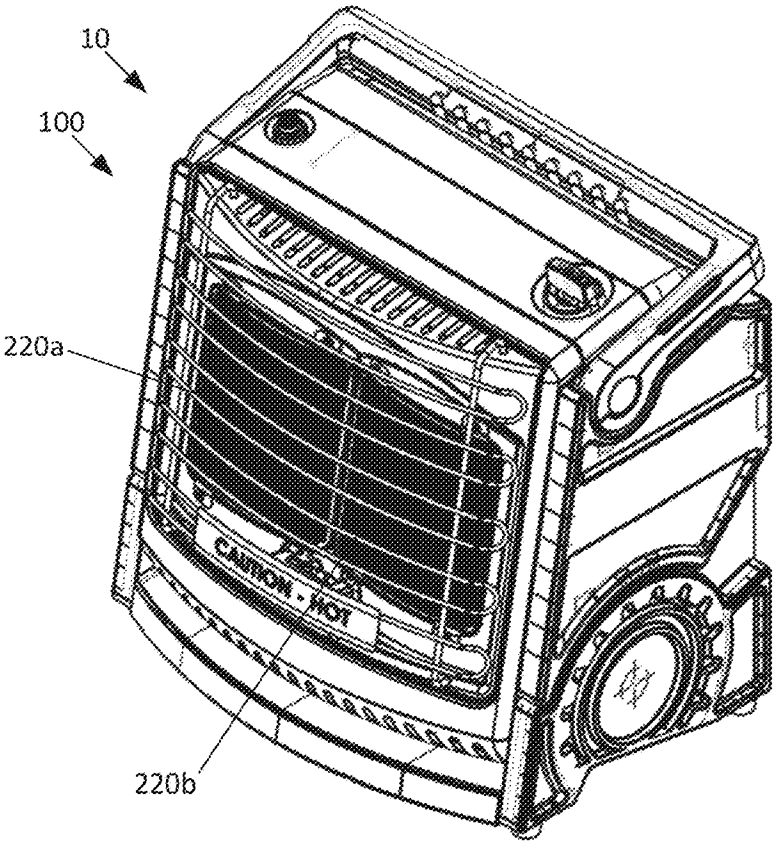
FIG. 53 is a front perspective of portable heater having features in accordance with principles of the disclosure.
Figure 54A:
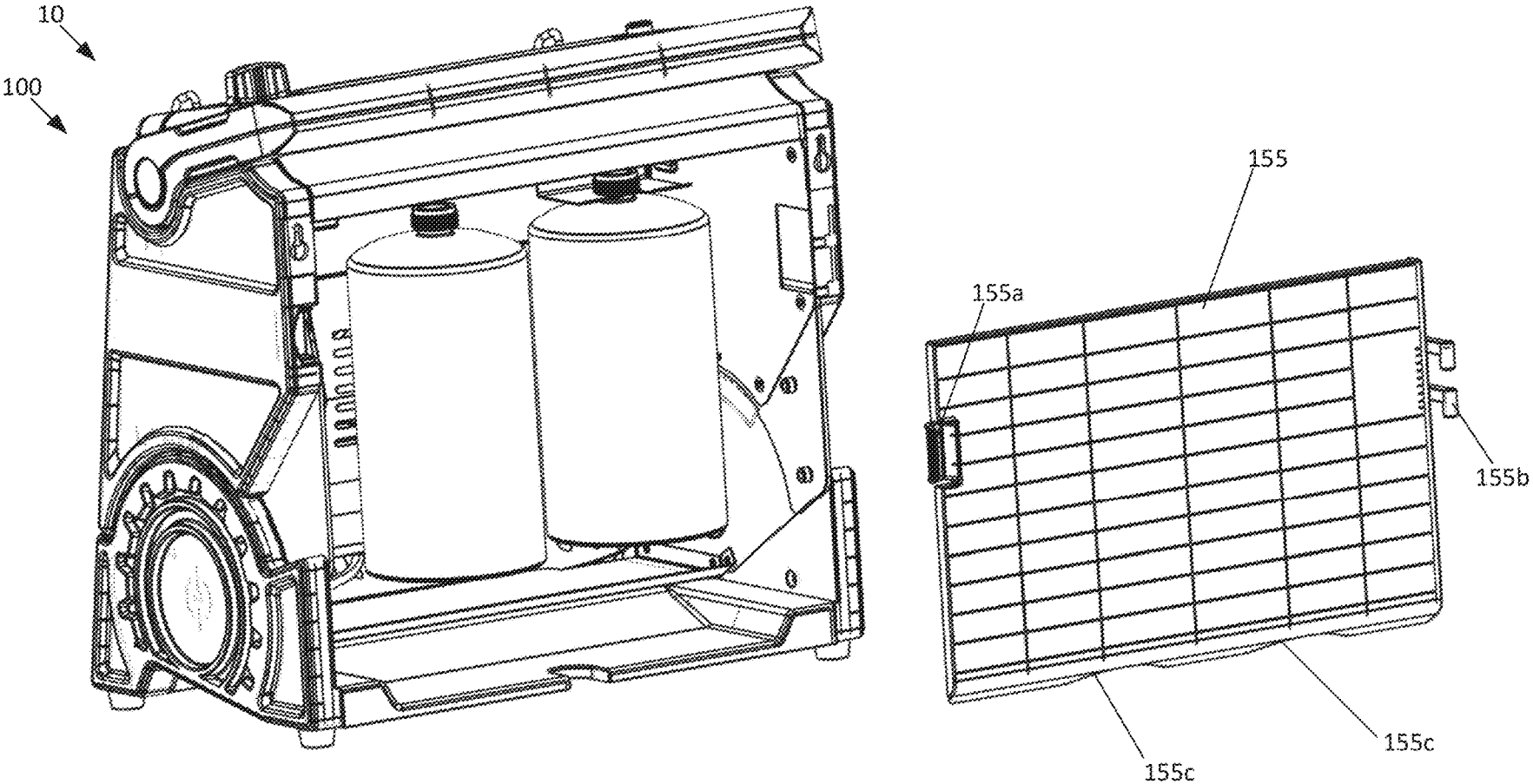
FIG. 54*a* is a rear perspective view of the portable heater shown in FIG. 53, with a rear cover removed from the enclosure of the portable heater.
Figure 56:
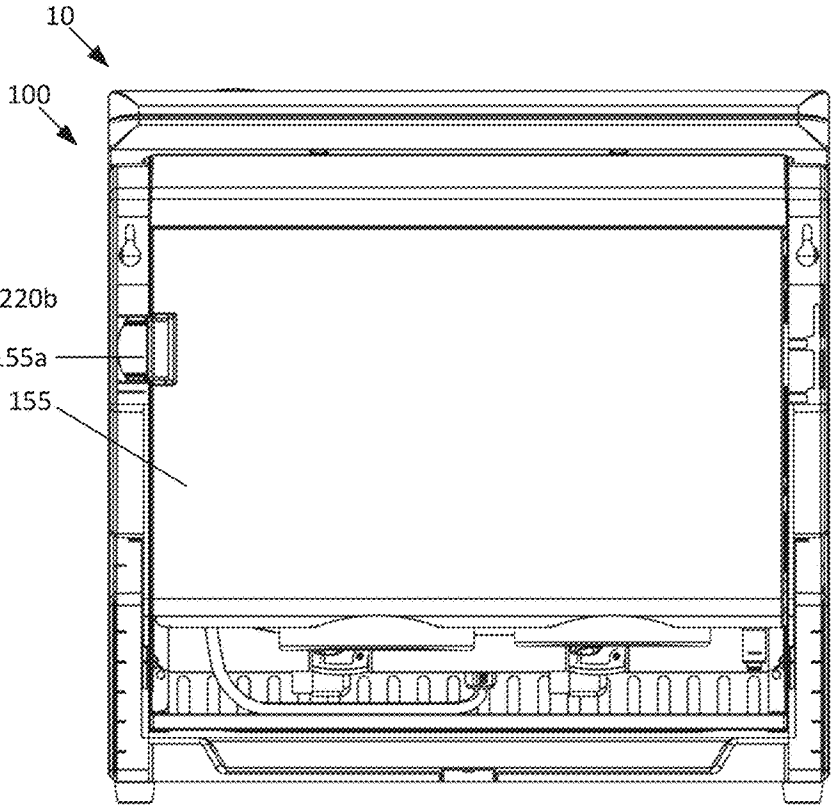
FIG. 56 is a rear view of the portable heater shown in FIG. 53.
Figure 55:
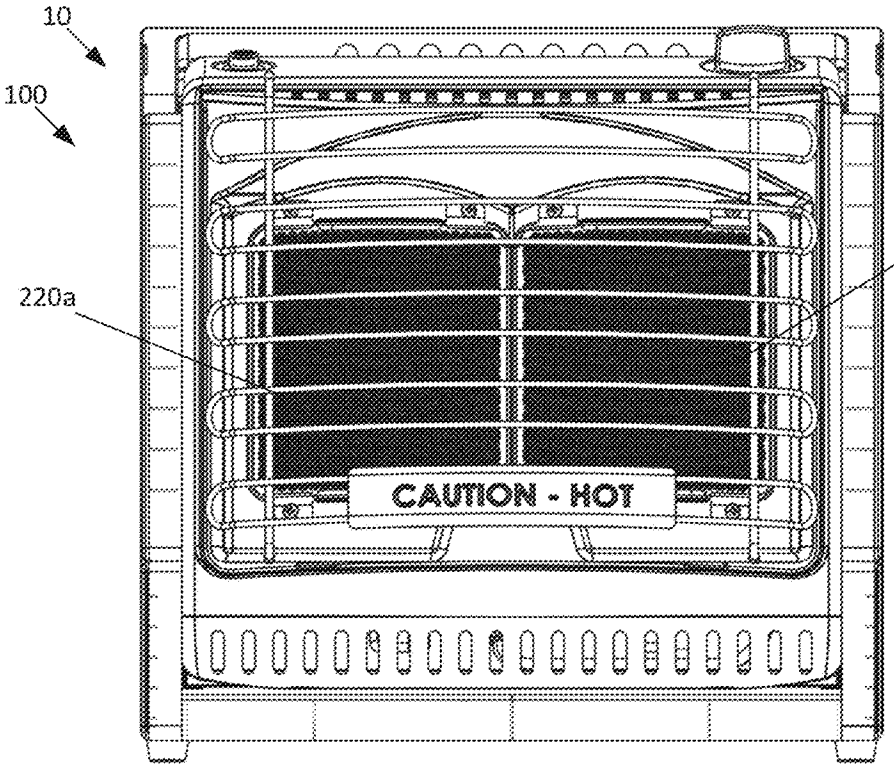
FIG. 55 is a front view of the portable heater shown in FIG. 53.
Figure 58:
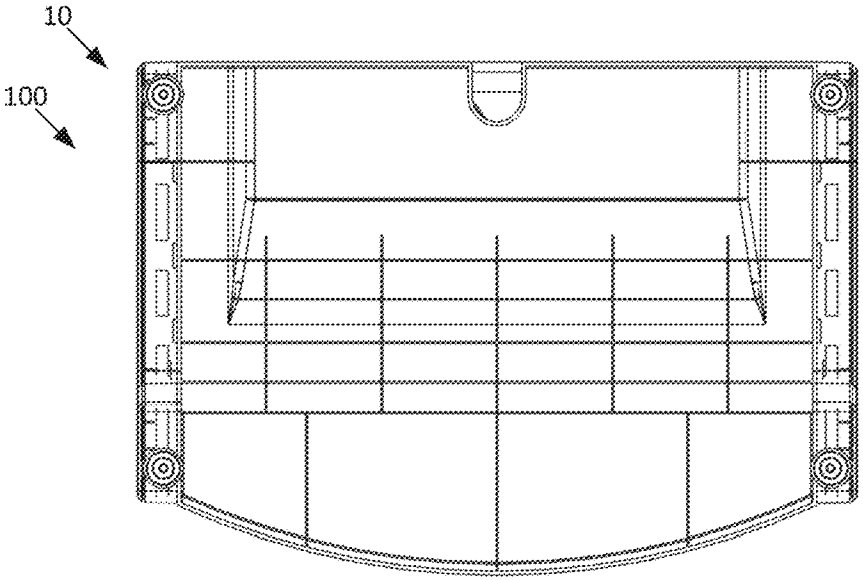
FIG. 58 is a bottom view of the portable heater shown in FIG. 53.
Figure 57:
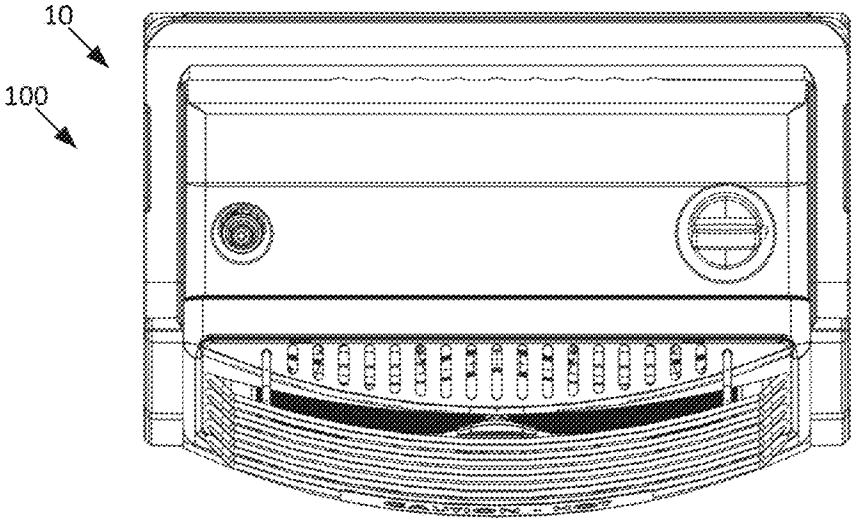
FIG. 57 is a top view of the portable heater shown in FIG. 53.
Figure 60:
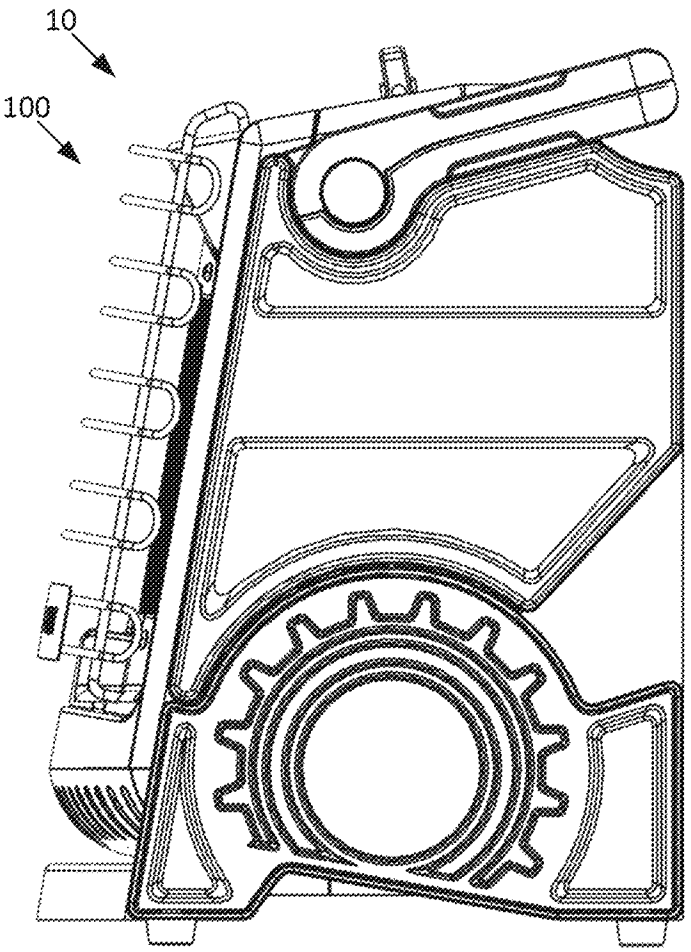
FIG. 60 is a second side view of the portable heater shown in FIG. 53.
Figure 59:
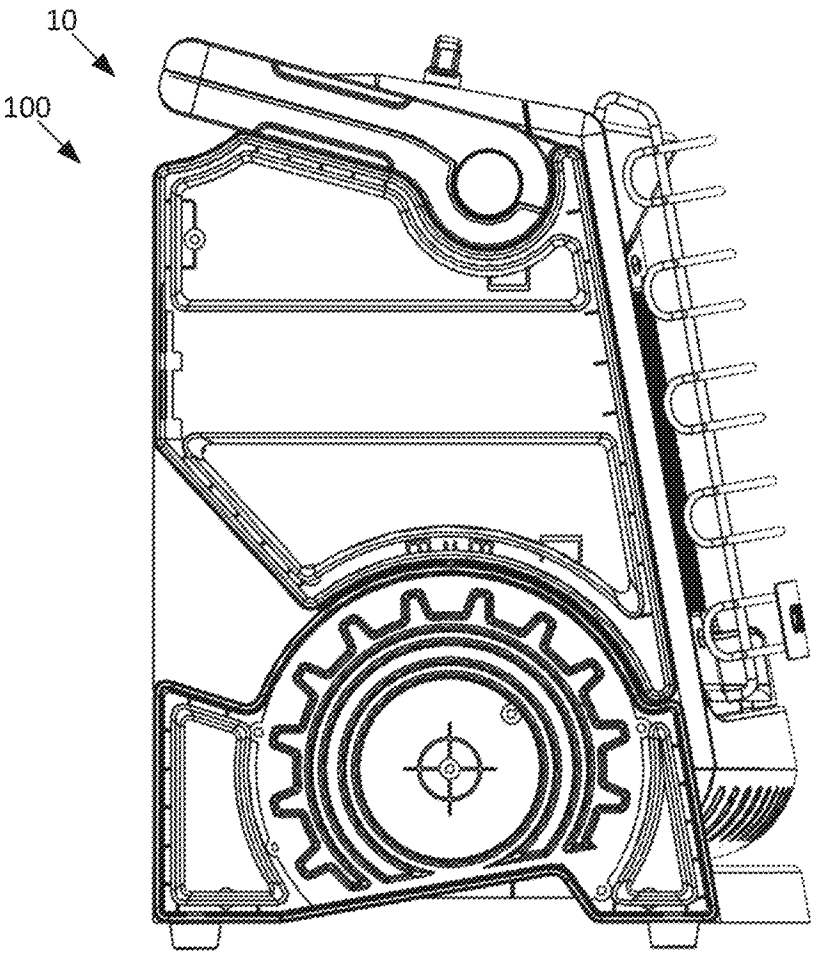
FIG. 59 is a first side view of the portable heater shown in FIG. 53.
Figure 61:
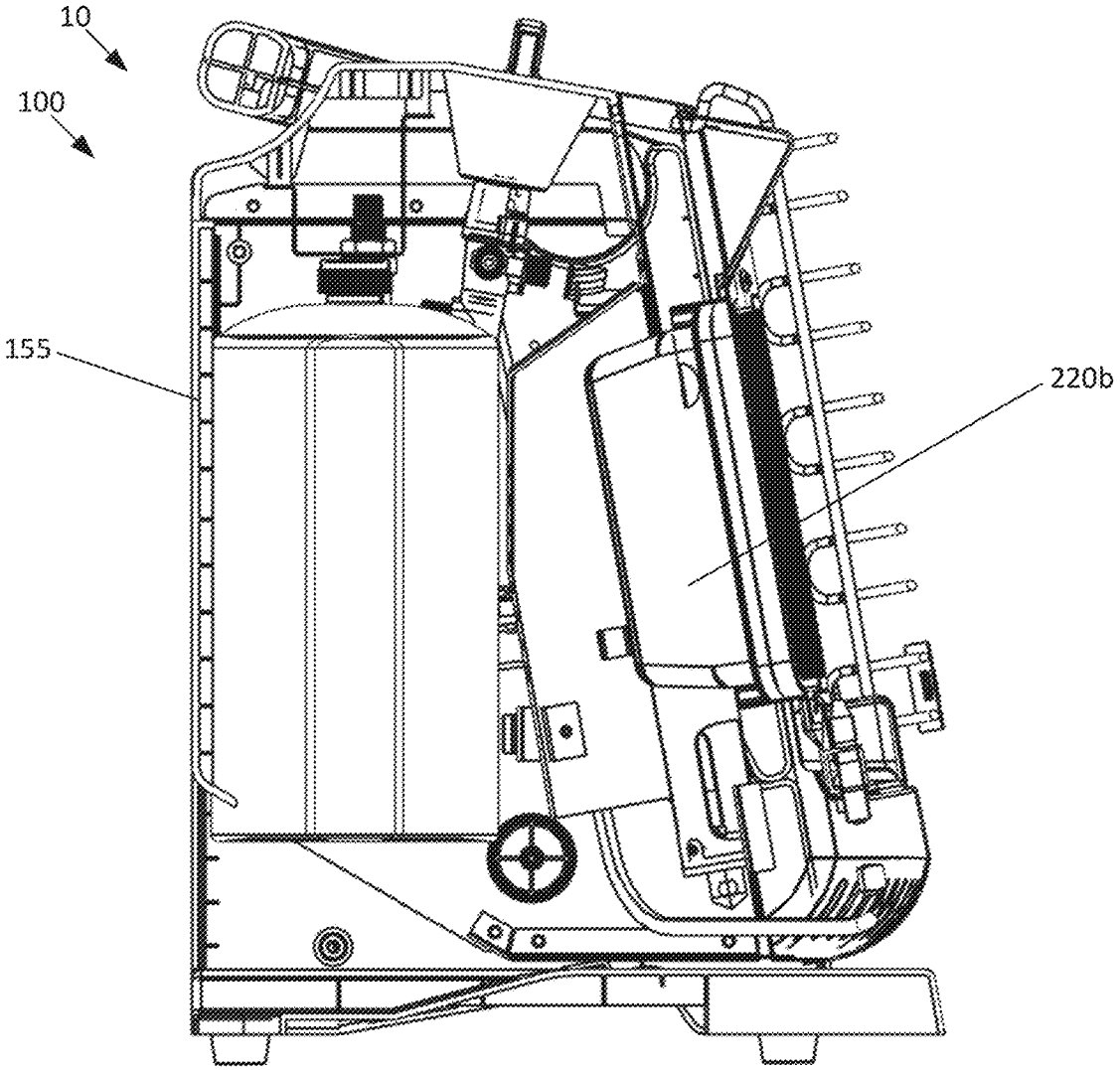
FIG. 61 is a cross-sectional side view of the portable heater shown in FIG. 60.
Figure 62:
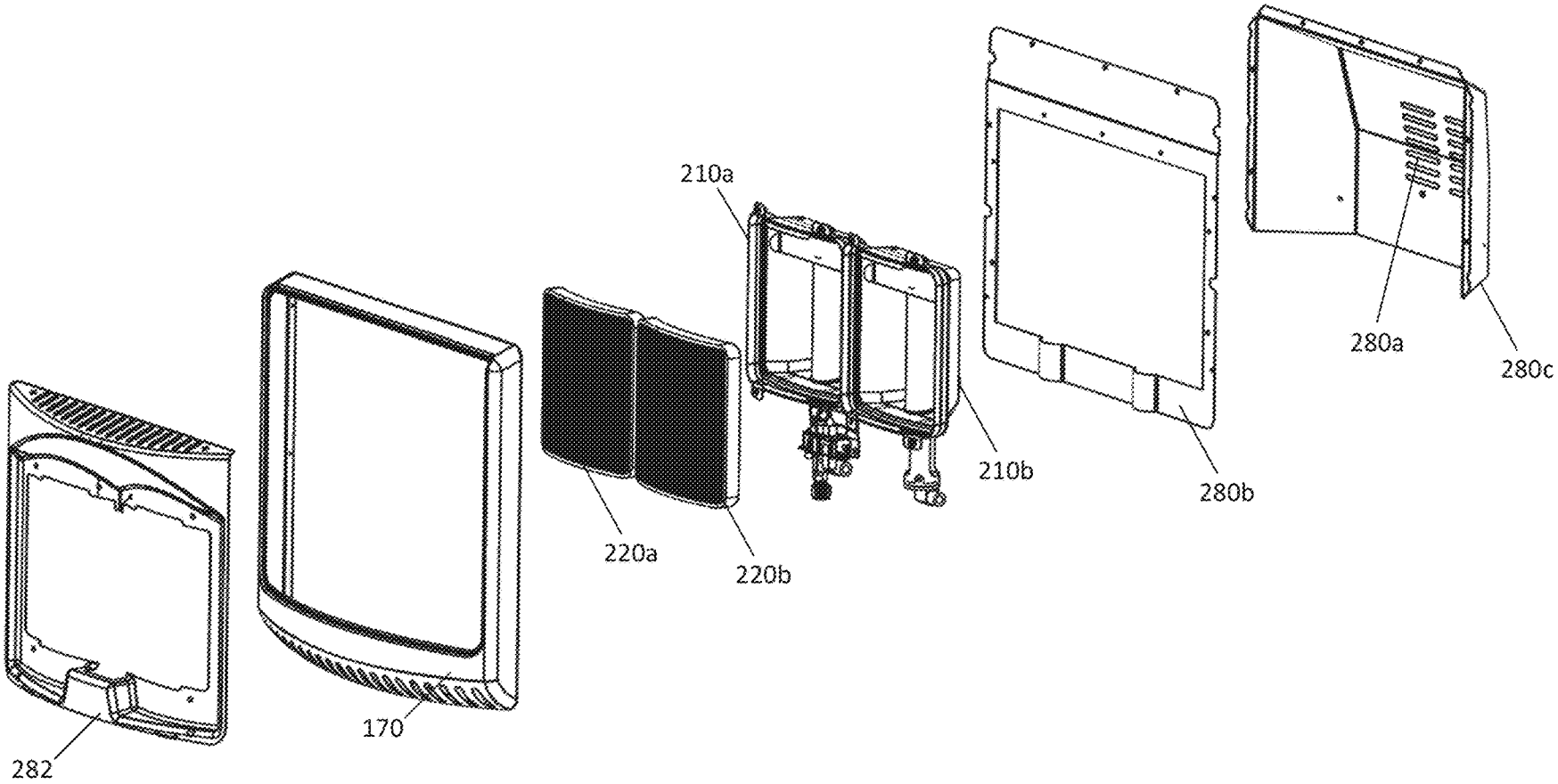
FIG. 62 is an exploded perspective view of a portion of the portable heater shown in FIG. 53, including a portion of a fuel and burner assembly.

With reference to FIG. 52, it can be viewed that the main frame 112 is provided as a multiple component assembly, rather than being formed as a unitary part. As shown, the main frame 112 is provided with a separate sidewalls 112*a*, 112*b* that attach to a separate end wall 112*f* via fasteners, such as screws. Such a configuration advantageously allows for ease and flexibility of manufacturability. Such a configuration is equally suitable for use with the portable heater 10 of FIGS. 1 to 38.

Figure 49:
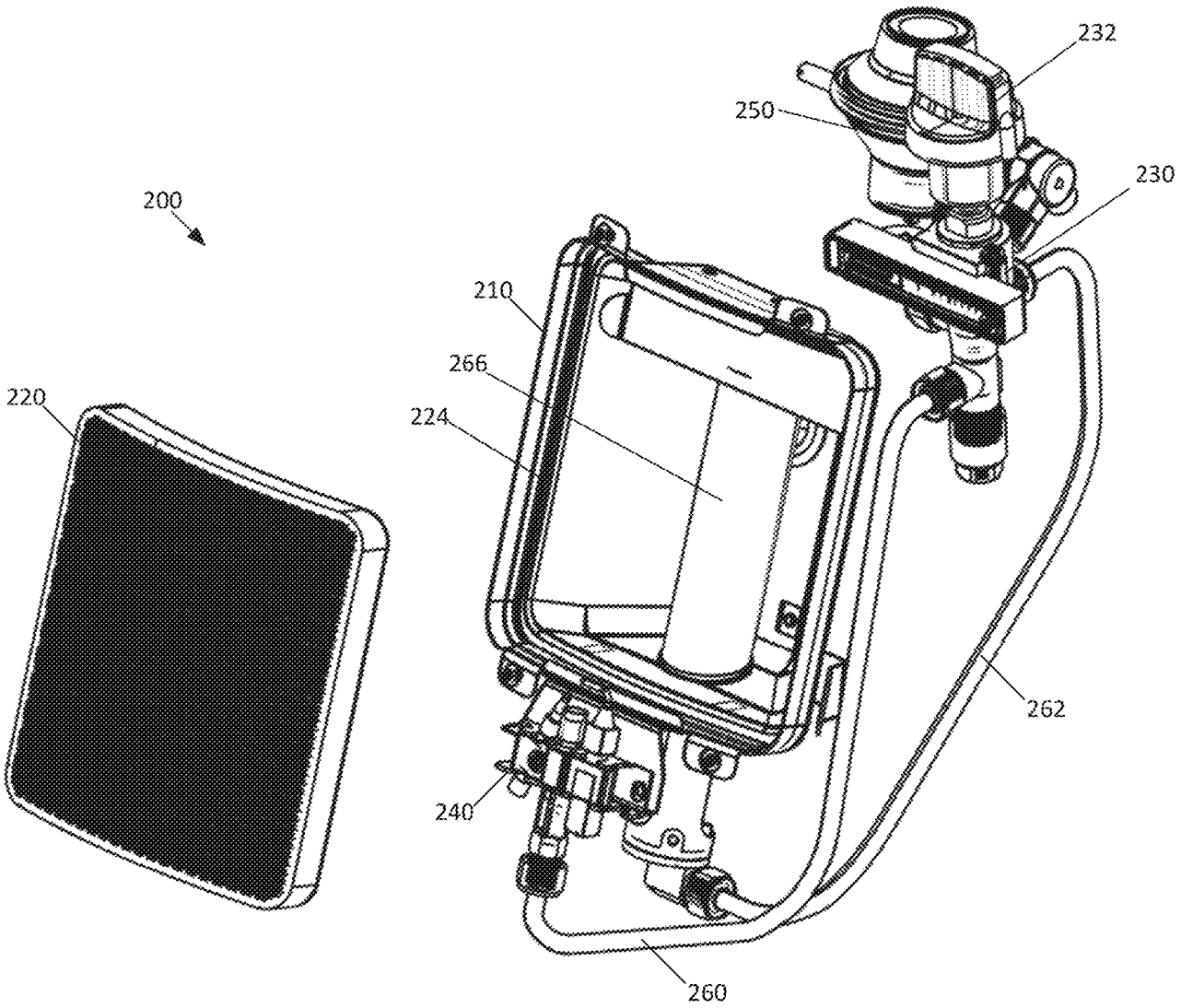
FIG. 49 is an exploded perspective view of a portion of a fuel and burner assembly of the portable heater shown in FIG. 39, shown with the heating element removed from the burner housing for clarity.
Figure 63:
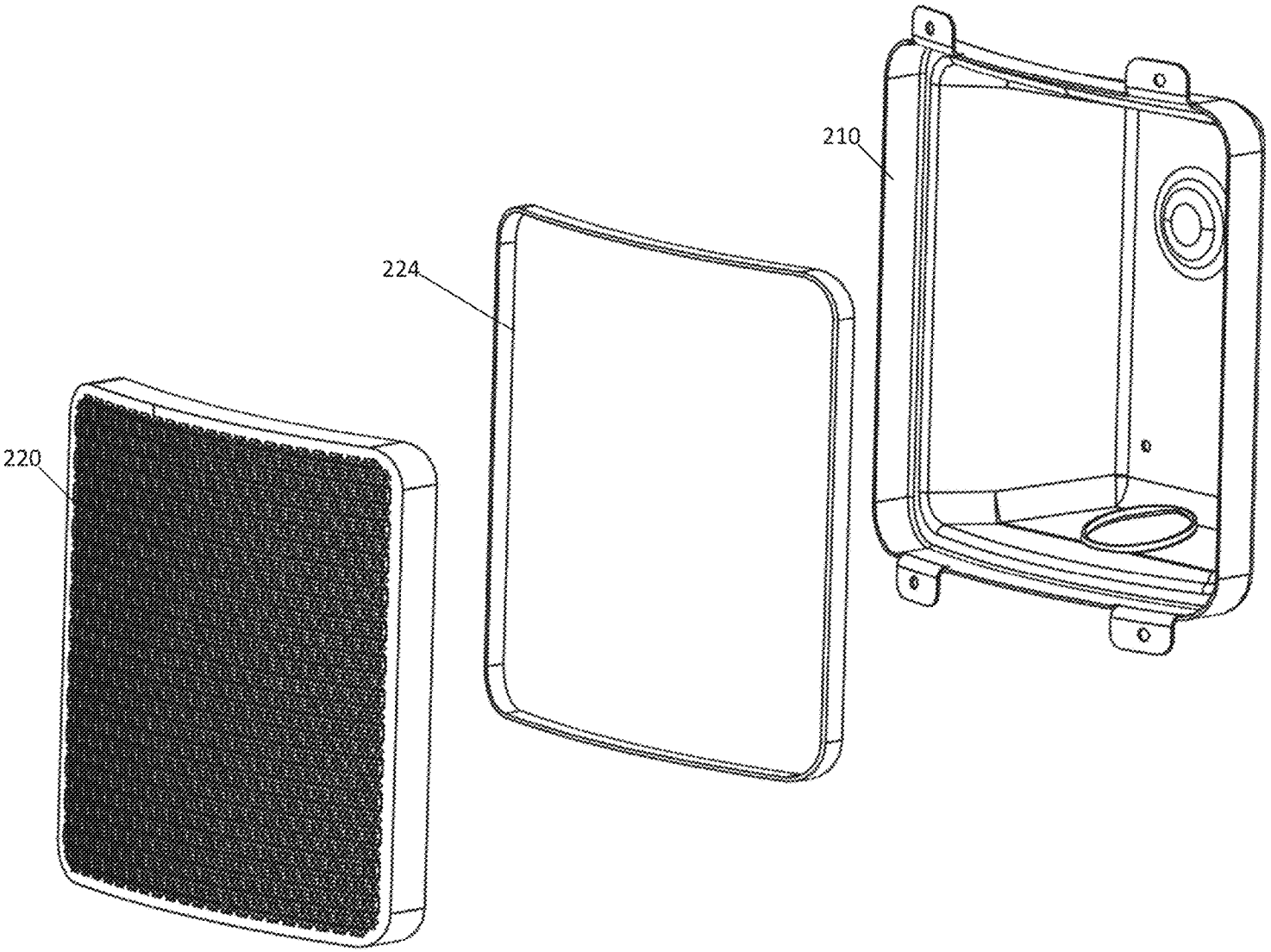
FIG. 63 is an exploded perspective view of a portion of the fuel and burner assembly shown in FIG. 62.

With reference to FIGS. 49 and 63, it can be viewed that a gasket 224 can be provided between the plaque 220 and the burner housing 210 such that a seal between the two components is formed and such that the plaque 220 is adequately secured to the housing 210. In one aspect, the gasket 224 is formed from a high temperature material, such as from ceramic fibers. Such a configuration is equally suitable for use with the portable heater 10 of FIGS. 1 to 38.

Referring to FIGS. 53 to 63, a third example of a portable heater 10 is presented. The portable heater 10 of FIGS. 53 to 63 is generally similar to the portable heater 10 of FIGS. 1 to 38 and of FIGS. 39 to 52, and includes many of the same features. For example, the portable heater 10 of FIGS. 53 to 63 is fully positionable between first and second rotational positions, is configured with a shaped heat shield having vent openings to safely provide heat to the fuel tank temperature for optimal operation in cold conditions, and has an internally mounted tilt switch that remains in position independent of the rotational position of the housing. Accordingly, the description for the portable heater 10 of FIGS. 1 to 38 is generally applicable to the portable heater of FIGS. 39 to 52, and need not be repeated here. Furthermore, the portable heater 10 of FIGS. 53 to 63 is additionally similar to the portable heater of FIGS. 39 to 52 in that the burner assembly has a vertical burner tube arrangement, in that the base, frame, and handle structures are provided as a multi-component assemblies, and in that a gasket structure is provided between the ceramic plaque and the burner housing. Accordingly, the description for the portable heater 10 of FIGS. 39 to 52 and 63 is generally applicable to the portable heater of FIGS. 53 to 63, and need not be repeated here. The description for the portable heater 10 of FIGS. 53 to 63 will thus be limited to the primary differences between the presented examples.

In one aspect, the portable heater 10 of FIGS. 53 to 63 is provided with a rear cover 155 which partially encloses the interior of the housing 100 and enclosure 110. With the rear cover installed, the interior of the housing 100 and enclosure 110 is more easily maintained at an elevated temperature via the waste heat from the back side of the burner housing via the heat shield and associated vents. Accordingly, the fuel tanks are maintained at a more optimal temperature for operation. In the example shown, the rear cover 155 is latched to the housing 100 with a snap-fit type construction including a deflectable latch member 155*a* and a hinge member 155*b* rotatably received by the enclosure 110. As configured, the cover 155 can be entirely removed from the enclosure 110 and can be installed onto the enclosure 110 by dropping the hinge member 155*b* into a corresponding recess in the enclosure 110 and then rotating the cover 155 until the latch member 155*a* engages with a corresponding structure on the enclosure 110. The rear cover 155 is also provided with contoured portions 155*c* (i.e. concave curved cut-out portions) which match the and abut against circumference of the fuel tanks 20 such that fuel tanks 20 are further secured within the enclosure 110. The rear cover 155 notably does not cover the entire back side of the housing 100 and enclosure 110, thereby allowing for heat to escape from the interior and preventing potential overheating within the unit. In the example shown, the rear cover 155 covers the upper portion of the back side of the heater and leaves an open region at a lower portion. In the example shown, the cover 155 covers a majority of the rear side of the portable heater housing 100 and enclosure 110. Such a configuration is equally suitable for use with the portable heater 10 of FIGS. 1 to 38 and FIGS. 39 to 52.

In one aspect, the portable heater 10 of FIGS. 53 to 63 is provided with two burner housings 210*a*, 210*b* and heating elements 220*a*, 220*b*, arranged in a side-by-side arrangement, rather than utilizing a single burner arrangement. However, a common pilot light assembly 240, front part 170, front heat shield 282, rear heat shield 280 are still provided. It is noted that, with all disclosed embodiments, the heat shield 280 is provided as a two part assembly with a front portion 280*b* and a rear portion 280*c*. In one aspect, the fuel line 262 is branched to each of the burner housings 210 which each include an internal burner tube 266*a*, 266*b*. With such an arrangement, a modular approach is developed such that the same burner housing and heating element structure can be used in different portable heaters 10 having varying capacities. For example, the portable heater 10 of FIGS. 39 to 52 incorporates a single one of the disclosed burner housing 210 and heating element 220. A portable heater 10 having more than two of the burner housings 210 and heating elements 220 is also possible. The disclosed configuration also allows for the individual burner housings 210*a*, 210*b* to have a shallower depth as compared to a burner housing for a single, larger heating element 220, thereby enabling the size of the portable heater 10 to be reduced.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. A portable heater comprising:

a housing including a base and an enclosure;

a burner assembly disposed within the enclosure, the burner assembly including a heating surface; and a tilt switch operable to disable the burner assembly under a tilt condition;

wherein the enclosure and the heating surface are rotatable, with respect to the base, between a first rotational position and a second rotational position and wherein the orientation of the tilt switch is independent of the first and second rotational positions.

2. The portable heater of claim 1, further comprising a handle rotatably secured to the enclosure.

3. The portable heater of claim 1, wherein the second rotational position is at least 45 degrees from the first rotational position.

4. The portable heater of claim 1, wherein the first rotational position is 10 degrees with respect to a first plane, the first plane being orthogonal to a second plane defining a bottom-most portion of the base, and wherein the second rotational position is 60 degrees with respect to the first plane.

5. The portable heater of claim 1, wherein the heating surface is infinitely positionable between the first and second rotational positions.

6. The portable heater of claim 1, wherein the heating surface is incrementally positionable between the first and second rotational positions.

7. The portable heater of claim 6, further including a positioning arrangement having a first indexing part associated with the base and a second indexing part associated with the enclosure, wherein the first indexing part indexes with the second indexing part to provide incremental rotational positions between the enclosure and the base.

8. The portable heater of claim 7, further including a first side part mounted to a first side of the enclosure and a second side part mounted to a second side of the enclosure, wherein the second indexing part is mounted to the first side part.

9. The portable heater of claim 1, wherein the burner assembly includes a pilot light and an oxygen depletion sensor, wherein the pilot light and oxygen depletion sensor are operable between the first and second rotational positions.

10. The portable heater of claim 1, wherein the burner assembly includes a gas pressure regulating valve configured to receive a fuel tank, wherein the gas pressure regulating valve is rotatable with respect to the enclosure.

11. The portable heater of claim 1, wherein the burner assembly includes a heat shield separating the heating surface from a receiving area for receiving a fuel tank, wherein the heat shield includes one or more apertures for allowing heat from the heating surface to pass through to the receiving area.

12. The portable heater of claim 1, wherein the heating surface is a curved surface and has pores extending generally orthogonally to the heating surface.

* * * * *